US009410744B2

(12) United States Patent
Cooper

(10) Patent No.: US 9,410,744 B2
(45) **Date of Patent: *Aug. 9, 2016**

(54) VESSEL TRANSFER INSERT AND SYSTEM

(71) Applicant: Paul V. Cooper, Chesterland, OH (US)

(72) Inventor: Paul V. Cooper, Chesterland, OH (US)

(73) Assignee: Molten Metal Equipment Innovations, LLC, Middlefield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/843,947

(22) Filed: Mar. 15, 2013

(65) Prior Publication Data

US 2013/0292427 A1 Nov. 7, 2013

Related U.S. Application Data

(63) Continuation-in-part of application No. 13/797,616, filed on Mar. 12, 2013, now Pat. No. 9,017,597, and a continuation-in-part of application No. 13/801,907, filed on Mar. 13, 2013, now Pat. No. 9,205,490, and a continuation-in-part of application No. 13/802,040, filed on Mar. 13, 2013, now Pat. No. 9,156,087, and a continuation-in-part of application No. 13/802,203, filed on Mar. 13, 2013, and a continuation-in-part of application No. 13/106,853, filed on May 12, 2011, now Pat. No. 8,613,884.

(51) Int. Cl.

| | |
|---|---|
| ***F27D 3/14*** | (2006.01) |
| ***B22D 41/00*** | (2006.01) |
| ***B22D 37/00*** | (2006.01) |
| ***B22D 7/00*** | (2006.01) |
| ***B22D 39/00*** | (2006.01) |
| ***C22B 21/00*** | (2006.01) |
| ***C22B 21/06*** | (2006.01) |

(Continued)

(52) U.S. Cl.

CPC .. *F27D 3/14* (2013.01); *B22D 7/00* (2013.01); *B22D 37/00* (2013.01); *B22D 39/00* (2013.01); *B22D 41/00* (2013.01); *C22B 21/0084* (2013.01); *C22B 21/064* (2013.01); *F27D 3/0024* (2013.01); *F27D 27/005* (2013.01)

(58) Field of Classification Search

CPC ..... F27D 27/005; F27D 3/14; B22D 37/00; B22D 39/00; C22B 21/0084

USPC ..... 266/239, 274, 275; 222/590, 591

See application file for complete search history.

(56) References Cited

U.S. PATENT DOCUMENTS

| | | | |
|---|---|---|---|
| 35,604 | A | 6/1862 | Guild |
| 116,797 | A | 7/1871 | Barnhart |

(Continued)

FOREIGN PATENT DOCUMENTS

| | | |
|---|---|---|
| CA | 683469 | 3/1964 |
| CA | 2115929 | 8/1992 |

(Continued)

OTHER PUBLICATIONS

US 5,961,265, 10/1999, Meneice et al. (withdrawn).

(Continued)

*Primary Examiner* — Scott Kastler

(74) *Attorney, Agent, or Firm* — Snell & Wilmer L.L.P.

(57) ABSTRACT

A system for removing molten metal from a vessel is disclosed. The system includes a pump and a refractory casing that houses the pump. As the pump operates it moves molten metal upward through an uptake section of the casing until it reaches an outlet wherein it exits the vessel. The outlet may be attached to a launder. Another system uses a wall to divide a cavity of the chamber into two portions. The wall has an opening and a pump pumps molten metal from a first portion into a second portion until the level in the second portion reaches an outlet and exits the vessel.

11 Claims, 24 Drawing Sheets

(51) Int. Cl.
*F27D 27/00* (2010.01)
*F27D 3/00* (2006.01)

(56) References Cited

U.S. PATENT DOCUMENTS

| | | | |
|---|---|---|---|
| 209,219 | A | 10/1878 | Bookwalter |
| 251,104 | A | 12/1881 | Finch |
| 364,804 | A | 6/1887 | Cole |
| 390,319 | A | 10/1888 | Thomson |
| 495,760 | A | 4/1893 | Seitz |
| 506,572 | A | 10/1893 | Wagener |
| 585,188 | A | 6/1897 | Davis |
| 757,932 | A | 4/1904 | Jones |
| 882,477 | A | 3/1908 | Neumann |
| 882,478 | A | 3/1908 | Neumann |
| 890,319 | A | 6/1908 | Wells |
| 898,499 | A | 9/1908 | O'Donnell |
| 909,774 | A | 1/1909 | Flora |
| 919,194 | A | 4/1909 | Livingston |
| 1,037,659 | A | 9/1912 | Rembert |
| 1,100,475 | A | 6/1914 | Franckaerts |
| 1,170,512 | A | 2/1916 | Chapman |
| 1,196,758 | A | 9/1916 | Blair |
| 1,304,068 | A | 5/1919 | Krogh |
| 1,331,997 | A | 2/1920 | Neal |
| 1,377,101 | A | 5/1921 | Sparling |
| 1,380,798 | A | 6/1921 | Hansen et al. |
| 1,439,365 | A | 12/1922 | Hazell |
| 1,454,967 | A | 5/1923 | Gill |
| 1,470,607 | A | 10/1923 | Hazell |
| 1,513,875 | A | 11/1924 | Wilke |
| 1,518,501 | A | 12/1924 | Gill |
| 1,522,765 | A | 1/1925 | Wilke |
| 1,526,851 | A | 2/1925 | Hall |
| 1,669,668 | A | 5/1928 | Marshall |
| 1,673,594 | A | 6/1928 | Schmidt |
| 1,697,202 | A | 1/1929 | Nagle |
| 1,717,969 | A | 6/1929 | Goodner |
| 1,718,396 | A | 6/1929 | Wheeler |
| 1,896,201 | A | 2/1933 | Sterner-Rainer |
| 1,988,875 | A | 1/1935 | Saborio |
| 2,013,455 | A | 9/1935 | Baxter |
| 2,038,221 | A | 4/1936 | Kagi |
| 2,075,633 | A | 3/1937 | Anderegg |
| 2,090,162 | A | 8/1937 | Tighe |
| 2,091,677 | A | 8/1937 | Fredericks |
| 2,138,814 | A | 12/1938 | Bressler |
| 2,173,377 | A | 9/1939 | Schultz, Jr. et al. |
| 2,264,740 | A | 12/1941 | Brown |
| 2,280,979 | A | 4/1942 | Rocke |
| 2,290,961 | A | 7/1942 | Heuer |
| 2,300,688 | A | 11/1942 | Nagle |
| 2,304,849 | A | 12/1942 | Ruthman |
| 2,368,962 | A | 2/1945 | Blom |
| 2,383,424 | A | 8/1945 | Stepanoff |
| 2,423,655 | A | 7/1947 | Mars et al. |
| 2,488,447 | A | 11/1949 | Tangen et al. |
| 2,493,467 | A | 1/1950 | Sunnen |
| 2,515,097 | A | 7/1950 | Schryber |
| 2,515,478 | A | 7/1950 | Tooley et al. |
| 2,528,208 | A | 10/1950 | Bonsack et al. |
| 2,528,210 | A | 10/1950 | Stewart |
| 2,543,633 | A | 2/1951 | Lamphere |
| 2,566,892 | A | 9/1951 | Jacobs |
| 2,625,720 | A | 1/1953 | Ross |
| 2,626,086 | A | 1/1953 | Forrest |
| 2,676,279 | A | 4/1954 | Wilson |
| 2,677,609 | A | 5/1954 | Moore et al. |
| 2,698,583 | A | 1/1955 | House et al. |
| 2,714,354 | A | 8/1955 | Farrand |
| 2,762,095 | A | 9/1956 | Pemetzrieder |
| 2,768,587 | A | 10/1956 | Coma |
| 2,775,348 | A | 12/1956 | Williams |
| 2,779,574 | A | 1/1957 | Schneider |
| 2,787,873 | A | 4/1957 | Hadley |
| 2,808,782 | A | 10/1957 | Thompson et al. |
| 2,809,107 | A | 10/1957 | Russell |
| 2,821,472 | A | 1/1958 | Peterson et al. |
| 2,824,520 | A | 2/1958 | Bartels |
| 2,832,292 | A | 4/1958 | Edwards |
| 2,839,006 | A | 6/1958 | Mayo |
| 2,853,019 | A | 9/1958 | Thorton |
| 2,865,618 | A | 12/1958 | Abell |
| 2,868,132 | A | 12/1958 | Nikolaus |
| 2,865,295 | A | 1/1959 | Rittershofer |
| 2,901,677 | A | 8/1959 | Chessman et al. |
| 2,906,632 | A | 9/1959 | Nickerson |
| 2,918,876 | A | 12/1959 | Howe |
| 2,948,524 | A | 8/1960 | Sweeney et al. |
| 2,958,293 | A | 11/1960 | Pray, Jr. |
| 2,978,885 | A | 4/1961 | Davison |
| 2,984,524 | A | 5/1961 | Franzen |
| 2,987,885 | A | 6/1961 | Hodge |
| 3,010,402 | A | 11/1961 | King |
| 3,015,190 | A | 1/1962 | Arbeit |
| 3,039,864 | A | 6/1962 | Hess |
| 3,044,408 | A | 7/1962 | Mellott |
| 3,048,384 | A | 8/1962 | Sweeney et al. |
| 3,070,393 | A | 12/1962 | Silverberg et al. |
| 3,092,030 | A | 6/1963 | Wunder |
| 3,099,870 | A | 8/1963 | Seeler |
| 3,128,327 | A | 4/1964 | Upton |
| 3,130,678 | A | 4/1964 | Chenault |
| 3,130,679 | A | 4/1964 | Sence |
| 3,171,357 | A | 3/1965 | Egger |
| 3,172,850 | A | 3/1965 | Hance |
| 3,203,182 | A | 8/1965 | Pohl |
| 3,227,547 | A | 1/1966 | Szekely |
| 3,244,109 | A | 4/1966 | Barske |
| 3,251,676 | A | 5/1966 | Johnson |
| 3,255,702 | A | 6/1966 | Gehrm |
| 3,258,283 | A | 6/1966 | Winberg et al. |
| 3,272,619 | A | 9/1966 | Sweeney et al. |
| 3,289,473 | A | 12/1966 | Louda |
| 3,291,473 | A | 12/1966 | Sweeney et al. |
| 3,368,805 | A | 2/1968 | Davey et al. |
| 3,374,943 | A | 3/1968 | Cervenka |
| 3,400,923 | A | 9/1968 | Howie et al. |
| 3,417,929 | A | 12/1968 | Secrest et al. |
| 3,432,336 | A | 3/1969 | Langrod |
| 3,459,133 | A | 8/1969 | Scheffler |
| 3,459,346 | A | 8/1969 | Tinnes |
| 3,477,383 | A | 11/1969 | Rawson et al. |
| 3,487,805 | A | 1/1970 | Satterthwaite |
| 1,185,314 | A | 3/1970 | London |
| 3,512,762 | A | 5/1970 | Umbricht |
| 3,512,788 | A | 5/1970 | Kilbane |
| 3,532,445 | A | 10/1970 | Scheffler et al. |
| 3,561,885 | A | 2/1971 | Lake |
| 3,575,525 | A | 4/1971 | Fox et al. |
| 3,581,767 | A | 6/1971 | Jackson |
| 3,612,715 | A | 10/1971 | Yedidiah |
| 3,618,917 | A | 11/1971 | Fredrikson |
| 3,620,716 | A | 11/1971 | Hess |
| 3,650,730 | A | 3/1972 | Derham et al. |
| 3,689,048 | A | 9/1972 | Foulard et al. |
| 3,715,112 | A | 2/1973 | Carbonnel |
| 3,732,032 | A | 5/1973 | Daneel |
| 3,737,304 | A | 6/1973 | Blayden |
| 3,737,305 | A | 6/1973 | Blayden et al. |
| 3,743,263 | A | 7/1973 | Szekely |
| 3,743,500 | A | 7/1973 | Foulard et al. |
| 3,753,690 | A | 8/1973 | Emley et al. |
| 3,759,628 | A | 9/1973 | Kempf |
| 3,759,635 | A | 9/1973 | Carter et al. |
| 3,767,382 | A | 10/1973 | Bruno et al. |
| 3,776,660 | A | 12/1973 | Anderson et al. |
| 3,785,632 | A | 1/1974 | Kraemer et al. |
| 3,787,143 | A | 1/1974 | Carbonnel et al. |
| 3,799,522 | A | 3/1974 | Brant et al. |
| 3,799,523 | A | 3/1974 | Seki |
| 3,807,708 | A | 4/1974 | Jones |
| 3,814,400 | A | 6/1974 | Seki |
| 3,824,028 | A | 7/1974 | Zenkner et al. |

(56) References Cited

U.S. PATENT DOCUMENTS

| | | | |
|---|---|---|---|
| 3,824,042 | A | 7/1974 | Barnes et al. |
| 3,836,280 | A | 9/1974 | Koch |
| 3,839,019 | A | 10/1974 | Bruno et al. |
| 3,844,972 | A | 10/1974 | Tully, Jr. et al. |
| 3,871,872 | A | 3/1975 | Downing et al. |
| 3,873,073 | A | 3/1975 | Baum et al. |
| 3,873,305 | A | 3/1975 | Claxton et al. |
| 3,881,039 | A | 4/1975 | Baldieri et al. |
| 3,886,992 | A | 6/1975 | Maas et al. |
| 3,915,594 | A | 10/1975 | Nesseth |
| 3,915,694 | A | 10/1975 | Ando |
| 3,941,588 | A | 3/1976 | Dremann |
| 3,941,589 | A | 3/1976 | Norman et al. |
| 3,954,134 | A | 5/1976 | Maas et al. |
| 3,958,979 | A | 5/1976 | Valdo |
| 3,958,981 | A | 5/1976 | Forberg et al. |
| 3,961,778 | A | 6/1976 | Carbonnel et al. |
| 3,966,456 | A | 6/1976 | Ellenbaum et al. |
| 3,967,286 | A | 6/1976 | Andersson et al. |
| 3,972,709 | A | 8/1976 | Chia et al. |
| 3,973,871 | A | 8/1976 | Hance |
| 3,984,234 | A | 10/1976 | Claxton et al. |
| 3,985,000 | A | 10/1976 | Hartz |
| 3,997,336 | A | 12/1976 | van Linden et al. |
| 4,003,560 | A | 1/1977 | Carbonnel |
| 4,008,884 | A | 2/1977 | Fitzpatrick et al. |
| 4,018,598 | A | 4/1977 | Markus |
| 4,052,199 | A | 10/1977 | Mangalick |
| 4,055,390 | A | 10/1977 | Young |
| 4,063,849 | A | 12/1977 | Modianos |
| 4,068,965 | A | 1/1978 | Lichti |
| 4,073,606 | A | 2/1978 | Eller |
| 4,091,970 | A | 5/1978 | Komiyama et al. |
| 4,119,141 | A | 10/1978 | Thut et al. |
| 4,126,360 | A | 11/1978 | Miller et al. |
| 4,128,415 | A | 12/1978 | van Linden et al. |
| 4,169,584 | A | 10/1979 | Mangalick |
| 4,191,486 | A | 3/1980 | Pelton |
| 4,213,742 | A | 7/1980 | Henshaw |
| 4,242,039 | A | 12/1980 | Villard et al. |
| 4,244,423 | A | 1/1981 | Thut et al. |
| 4,286,985 | A | 9/1981 | van Linden et al. |
| 4,305,214 | A | 12/1981 | Hurst |
| 4,322,245 | A | 3/1982 | Claxton |
| 4,338,062 | A | 7/1982 | Neal |
| 4,347,041 | A | 8/1982 | Cooper |
| 4,351,514 | A | 9/1982 | Koch |
| 4,355,789 | A | 10/1982 | Dolzhenkov et al. |
| 4,356,940 | A | 11/1982 | Ansorge |
| 4,360,314 | A | 11/1982 | Pennell |
| 4,370,096 | A | 1/1983 | Church |
| 4,372,541 | A | 2/1983 | Bocourt et al. |
| 4,375,937 | A | 3/1983 | Cooper |
| 4,389,159 | A | 6/1983 | Sarvanne |
| 4,392,888 | A | 7/1983 | Eckert et al. |
| 4,410,299 | A | 10/1983 | Shimoyama |
| 4,419,049 | A | 12/1983 | Gerboth et al. |
| 4,456,424 | A | 6/1984 | Araoka |
| 4,470,846 | A | 9/1984 | Dube |
| 4,474,315 | A | 10/1984 | Gilbert et al. |
| 4,496,393 | A | 1/1985 | Lustenberger |
| 4,504,392 | A | 3/1985 | Groteke |
| 4,509,979 | A | 4/1985 | Bauer |
| 4,537,624 | A | 8/1985 | Tenhover et al. |
| 4,537,625 | A | 8/1985 | Tenhover et al. |
| 4,556,419 | A | 12/1985 | Otsuka et al. |
| 4,557,766 | A | 12/1985 | Tenhover et al. |
| 4,586,845 | A | 5/1986 | Morris |
| 4,592,700 | A | 6/1986 | Toguchi et al. |
| 4,594,052 | A | 6/1986 | Niskanen |
| 4,596,510 | A | 6/1986 | Arneth |
| 4,598,899 | A | 7/1986 | Cooper |
| 4,600,222 | A | 7/1986 | Appling |
| 4,607,825 | A | 8/1986 | Briolle et al. |
| 4,609,442 | A | 9/1986 | Tenhover et al. |
| 4,611,790 | A | 9/1986 | Otsuka et al. |
| 4,617,232 | A | 10/1986 | Chandler et al. |
| 4,634,105 | A | 1/1987 | Withers et al. |
| 4,640,666 | A | 2/1987 | Sodergard |
| 4,655,610 | A | 4/1987 | Al-Jaroudi |
| 4,673,434 | A | 6/1987 | Withers et al. |
| 4,684,281 | A | 8/1987 | Patterson |
| 4,685,822 | A | 8/1987 | Pelton |
| 4,696,703 | A | 9/1987 | Henderson et al. |
| 4,701,226 | A | 10/1987 | Henderson et al. |
| 4,702,768 | A | 10/1987 | Areauz et al. |
| 4,714,371 | A | 12/1987 | Cuse |
| 4,717,540 | A | 1/1988 | McRae et al. |
| 4,739,974 | A | 4/1988 | Mordue |
| 4,743,428 | A | 5/1988 | McRae et al. |
| 4,747,583 | A | 5/1988 | Gordon et al. |
| 4,767,230 | A | 8/1988 | Leas, Jr. |
| 4,770,701 | A | 9/1988 | Henderson et al. |
| 4,786,230 | A | 11/1988 | Thut |
| 4,802,656 | A | 2/1989 | Hudault et al. |
| 4,804,168 | A | 2/1989 | Otsuka et al. |
| 4,810,314 | A | 3/1989 | Henderson et al. |
| 4,834,573 | A | 5/1989 | Asano et al. |
| 4,842,227 | A | 6/1989 | Harrington et al. |
| 4,844,425 | A | 7/1989 | Piras et al. |
| 4,851,296 | A | 7/1989 | Tenhover et al. |
| 4,859,413 | A | 8/1989 | Harris et al. |
| 4,867,638 | A | 9/1989 | Handtmann et al. |
| 4,884,786 | A | 12/1989 | Gillespie |
| 4,898,367 | A | 2/1990 | Cooper |
| 4,908,060 | A | 3/1990 | Duenkelmann |
| 4,923,770 | A | 5/1990 | Grasselli et al. |
| 4,930,986 | A | 6/1990 | Cooper |
| 4,931,091 | A | 6/1990 | Waite et al. |
| 4,940,214 | A | 7/1990 | Gillespie |
| 4,940,384 | A | 7/1990 | Amra et al. |
| 4,954,167 | A | 9/1990 | Cooper |
| 4,973,433 | A | 11/1990 | Gilbert et al. |
| 4,986,736 | A | 1/1991 | Kajiwara et al. |
| 5,015,518 | A | 5/1991 | Sasaki et al. |
| 5,025,198 | A | 6/1991 | Mordue et al. |
| 5,028,211 | A | 7/1991 | Mordue et al. |
| 5,029,821 | A | 7/1991 | Bar-on et al. |
| 5,078,572 | A | 1/1992 | Amra et al. |
| 5,080,715 | A | 1/1992 | Provencher et al. |
| 5,083,753 | A | 1/1992 | Soofi |
| 5,088,893 | A | 2/1992 | Gilbert et al. |
| 5,092,821 | A | 3/1992 | Gilbert et al. |
| 5,098,134 | A | 3/1992 | Monckton |
| 5,114,312 | A | 5/1992 | Stanislao |
| 5,126,047 | A | 6/1992 | Martin et al. |
| 5,131,632 | A | 7/1992 | Olson |
| 5,143,357 | A | 9/1992 | Gilbert et al. |
| 5,145,322 | A | 9/1992 | Senior, Jr. et al. |
| 5,152,631 | A | 10/1992 | Bauer |
| 5,154,652 | A | 10/1992 | Ecklesdafer |
| 5,158,440 | A | 10/1992 | Cooper et al. |
| 5,162,858 | A | 11/1992 | Shoji et al. |
| 5,165,858 | A | 11/1992 | Gilbert et al. |
| 5,177,304 | A | 1/1993 | Nagel |
| 5,191,154 | A | 3/1993 | Nagel |
| 5,192,193 | A | 3/1993 | Cooper et al. |
| 5,202,100 | A | 4/1993 | Nagel et al. |
| 5,203,681 | A | 4/1993 | Cooper |
| 5,209,641 | A | 5/1993 | Hoglund et al. |
| 5,215,448 | A | 6/1993 | Cooper |
| 5,268,020 | A | 12/1993 | Claxton |
| 5,286,163 | A | 2/1994 | Amra et al. |
| 5,298,233 | A | 3/1994 | Nagel |
| 5,301,620 | A | 4/1994 | Nagel et al. |
| 5,303,903 | A | 4/1994 | Butler et al. |
| 5,308,045 | A | 5/1994 | Cooper |
| 5,310,412 | A | 5/1994 | Gilbert et al. |
| 5,318,360 | A | 6/1994 | Langer et al. |
| 5,322,547 | A | 6/1994 | Nagel et al. |
| 5,324,341 | A | 6/1994 | Nagel et al. |
| 5,330,328 | A | 7/1994 | Cooper |
| 5,354,940 | A | 10/1994 | Nagel |
| 5,358,549 | A | 10/1994 | Nagel et al. |

(56) References Cited

U.S. PATENT DOCUMENTS

| | | | |
|---|---|---|---|
| 5,358,697 | A | 10/1994 | Nagel |
| 5,364,078 | A | 11/1994 | Pelton |
| 5,369,063 | A | 11/1994 | Gee et al. |
| 5,388,633 | A | 2/1995 | Mercer, II et al. |
| 5,395,405 | A | 3/1995 | Nagel et al. |
| 5,399,074 | A | 3/1995 | Nose et al. |
| 5,407,294 | A | 4/1995 | Giannini |
| 5,411,240 | A | 5/1995 | Rapp et al. |
| 5,425,410 | A | 6/1995 | Reynolds |
| 5,431,551 | A | 7/1995 | Aquino et al. |
| 5,435,982 | A | 7/1995 | Wilkinson |
| 5,436,210 | A | 7/1995 | Wilkinson et al. |
| 5,443,572 | A | 8/1995 | Wilkinson et al. |
| 5,454,423 | A | 10/1995 | Tsuchida et al. |
| 5,468,280 | A | 11/1995 | Areaux |
| 5,470,201 | A | 11/1995 | Gilbert et al. |
| 5,484,265 | A | 1/1996 | Horvath et al. |
| 5,489,734 | A | 2/1996 | Nagel et al. |
| 5,491,279 | A | 2/1996 | Robert et al. |
| 5,495,746 | A | 3/1996 | Sigworth |
| 5,505,143 | A | 4/1996 | Nagel |
| 5,505,435 | A | 4/1996 | Laszlo |
| 5,509,791 | A | 4/1996 | Turner |
| 5,511,766 | A | 4/1996 | Vassilicos |
| 5,537,940 | A | 7/1996 | Nagel et al. |
| 5,543,558 | A | 8/1996 | Nagel et al. |
| 5,555,822 | A | 9/1996 | Loewen et al. |
| 5,558,501 | A | 9/1996 | Wang et al. |
| 5,558,505 | A | 9/1996 | Mordue et al. |
| 5,571,486 | A | 11/1996 | Robert et al. |
| 5,585,532 | A | 12/1996 | Nagel |
| 5,586,863 | A | 12/1996 | Gilbert et al. |
| 5,591,243 | A | 1/1997 | Colussi et al. |
| 5,597,289 | A | 1/1997 | Thut |
| 5,613,245 | A | 3/1997 | Robert |
| 5,616,167 | A | 4/1997 | Eckert |
| 5,622,481 | A | 4/1997 | Thut |
| 5,629,464 | A | 5/1997 | Bach et al. |
| 5,634,770 | A | 6/1997 | Gilbert et al. |
| 5,640,706 | A | 6/1997 | Nagel et al. |
| 5,640,707 | A | 6/1997 | Nagel et al. |
| 5,640,709 | A | 6/1997 | Nagel et al. |
| 5,655,849 | A | 8/1997 | McEwen et al. |
| 5,660,614 | A | 8/1997 | Waite et al. |
| 5,662,725 | A | 9/1997 | Cooper |
| 5,676,520 | A | 10/1997 | Thut |
| 5,678,244 | A | 10/1997 | Shaw et al. |
| 5,678,807 | A | 10/1997 | Cooper |
| 5,679,132 | A | 10/1997 | Rauenzahn et al. |
| 5,685,701 | A | 11/1997 | Chandler et al. |
| 5,690,888 | A | 11/1997 | Robert |
| 5,695,732 | A | 12/1997 | Sparks et al. |
| 5,716,195 | A | 2/1998 | Thut |
| 5,717,149 | A | 2/1998 | Nagel et al. |
| 5,718,416 | A | 2/1998 | Flisakowski et al. |
| 5,735,668 | A | 4/1998 | Klein |
| 5,735,935 | A | 4/1998 | Areaux |
| 5,741,422 | A | 4/1998 | Eichenmiller et al. |
| 5,744,117 | A | 4/1998 | Wilkinson et al. |
| 5,745,861 | A | 4/1998 | Bell et al. |
| 5,772,324 | A | 6/1998 | Falk |
| 5,776,420 | A | 7/1998 | Nagel |
| 5,785,494 | A | 7/1998 | Vild et al. |
| 5,842,832 | A | 12/1998 | Thut |
| 5,858,059 | A | 1/1999 | Abramovich et al. |
| 5,863,314 | A | 1/1999 | Morando |
| 5,866,095 | A | 2/1999 | McGeever et al. |
| 5,875,385 | A | 2/1999 | Stephenson et al. |
| 5,935,528 | A | 8/1999 | Stephenson et al. |
| 5,944,496 | A | 8/1999 | Cooper |
| 5,947,705 | A | 9/1999 | Mordue et al. |
| 5,951,243 | A | 9/1999 | Cooper |
| 5,961,285 | A | 10/1999 | Meneice et al. |
| 5,963,580 | A | 10/1999 | Eckert |
| 5,992,230 | A | 11/1999 | Scarpa et al. |
| 5,993,726 | A | 11/1999 | Huang |
| 5,993,728 | A | 11/1999 | Vild |
| 6,019,576 | A | 2/2000 | Thut |
| 6,027,685 | A | 2/2000 | Cooper |
| 6,036,745 | A | 3/2000 | Gilbert et al. |
| 6,074,455 | A | 6/2000 | van Linden et al. |
| 6,082,965 | A | 7/2000 | Morando |
| 6,093,000 | A | 7/2000 | Cooper |
| 6,096,109 | A | 8/2000 | Nagel et al. |
| 6,113,154 | A | 9/2000 | Thut |
| 6,123,523 | A | 9/2000 | Cooper |
| 6,152,691 | A | 11/2000 | Thut |
| 6,168,753 | B1 | 1/2001 | Morando |
| 6,187,096 | B1 | 2/2001 | Thut |
| 6,199,836 | B1 | 3/2001 | Rexford et al. |
| 6,217,823 | B1 | 4/2001 | Vild et al. |
| 6,231,639 | B1 | 5/2001 | Eichenmiller |
| 6,250,881 | B1 | 6/2001 | Mordue et al. |
| 6,254,340 | B1 | 7/2001 | Vild et al. |
| 6,270,717 | B1 | 8/2001 | Tremblay et al. |
| 6,280,157 | B1 | 8/2001 | Cooper |
| 6,293,759 | B1 | 9/2001 | Thut |
| 6,303,074 | B1 | 10/2001 | Cooper |
| 6,345,964 | B1 | 2/2002 | Cooper |
| 6,354,796 | B1 | 3/2002 | Morando |
| 6,358,467 | B1 | 3/2002 | Mordue |
| 6,364,930 | B1 | 4/2002 | Kos |
| 6,371,723 | B1 | 4/2002 | Grant et al. |
| 6,398,525 | B1 | 6/2002 | Cooper |
| 6,439,860 | B1 | 8/2002 | Greer |
| 6,451,247 | B1 | 9/2002 | Mordue et al. |
| 6,457,940 | B1 | 10/2002 | Lehman |
| 6,457,950 | B1 | 10/2002 | Cooper et al. |
| 6,464,458 | B2 | 10/2002 | Vild et al. |
| 6,464,459 | B2 | 10/2002 | Vild |
| 6,497,559 | B1 | 12/2002 | Grant |
| 6,500,228 | B1 | 12/2002 | Klingensmith et al. |
| 6,503,292 | B2 | 1/2003 | Klingensmith et al. |
| 6,524,066 | B2 | 2/2003 | Thut |
| 6,533,535 | B2 | 3/2003 | Thut |
| 6,551,060 | B2 | 4/2003 | Mordue et al. |
| 6,562,286 | B1 | 5/2003 | Lehman |
| 6,656,415 | B2 | 12/2003 | Kos |
| 6,679,936 | B2 | 1/2004 | Quackenbush |
| 6,689,310 | B1 | 2/2004 | Cooper |
| 6,709,234 | B2 | 3/2004 | Gilbert et al. |
| 6,723,276 | B1 | 4/2004 | Cooper |
| 6,805,834 | B2 | 10/2004 | Thut |
| 6,843,640 | B2 | 1/2005 | Mordue et al. |
| 6,848,497 | B2 | 2/2005 | Sale et al. |
| 6,869,271 | B2 | 3/2005 | Gilbert et al. |
| 6,869,564 | B2 | 3/2005 | Gilbert et al. |
| 6,881,030 | B2 | 4/2005 | Thut |
| 6,887,424 | B2 | 5/2005 | Ohno et al. |
| 6,887,425 | B2 | 5/2005 | Mordue et al. |
| 6,902,696 | B2 | 6/2005 | Klingensmith et al. |
| 7,037,462 | B2 | 5/2006 | Klingensmith et al. |
| 7,083,758 | B2 | 8/2006 | Tremblay |
| 7,131,482 | B2 | 11/2006 | Vincent et al. |
| 7,157,043 | B2 | 1/2007 | Neff |
| 7,279,128 | B2 | 10/2007 | Kennedy et al. |
| 7,326,028 | B2 | 2/2008 | Morando |
| 7,402,276 | B2 | 7/2008 | Cooper |
| 7,470,392 | B2 | 12/2008 | Cooper |
| 7,476,357 | B2 | 1/2009 | Thut |
| 7,497,988 | B2 | 3/2009 | Thut |
| 7,507,367 | B2 | 3/2009 | Cooper |
| 7,543,605 | B1 | 6/2009 | Morando |
| 7,731,891 | B2 | 6/2010 | Cooper |
| 7,906,068 | B2 | 3/2011 | Cooper |
| 8,110,141 | B2 | 2/2012 | Cooper |
| 8,137,023 | B2 | 3/2012 | Greer |
| 8,137,923 | B2 | 3/2012 | Greer |
| 8,142,145 | B2 | 3/2012 | Thut |
| 8,178,037 | B2 | 5/2012 | Cooper |
| 8,328,540 | B2 | 12/2012 | Wang |
| 8,333,921 | B2 | 12/2012 | Thut |
| 8,337,746 | B2 | 12/2012 | Cooper |
| 8,361,379 | B2 | 1/2013 | Cooper |

(56) References Cited

U.S. PATENT DOCUMENTS

| | | | | |
|---|---|---|---|---|
| 8,366,993 | B2 | 2/2013 | Cooper | |
| 8,409,495 | B2 | 4/2013 | Cooper | |
| 8,440,135 | B2 | 5/2013 | Cooper | |
| 8,444,911 | B2 | 5/2013 | Cooper | |
| 8,449,814 | B2 | 5/2013 | Cooper | |
| 8,469,495 | B2 | 6/2013 | Gerstenberger et al. | |
| 8,475,594 | B2 | 7/2013 | Bright et al. | |
| 8,475,708 | B2 | 7/2013 | Cooper | |
| 8,480,950 | B2 | 7/2013 | Jetten et al. | |
| 8,501,084 | B2 | 8/2013 | Cooper | |
| 8,524,146 | B2 | 9/2013 | Cooper | |
| 8,529,828 | B2 | 9/2013 | Cooper | |
| 8,535,603 | B2 | 9/2013 | Cooper | |
| 8,580,218 | B2 | 11/2013 | Turenne et al. | |
| 8,613,884 | B2 | 12/2013 | Cooper | |
| 8,714,914 | B2 | 5/2014 | Cooper | |
| 8,753,563 | B2 | 6/2014 | Cooper | |
| 8,899,932 | B2 | 12/2014 | Tetkoskie et al. | |
| 8,915,830 | B2 | 12/2014 | March et al. | |
| 8,920,680 | B2 | 12/2014 | Mao | |
| 9,011,761 | B2 | 4/2015 | Cooper | |
| 9,017,597 | B2 | 4/2015 | Cooper | |
| 9,034,244 | B2 | 5/2015 | Cooper | |
| 9,108,244 | B2 | 8/2015 | Cooper | |
| 9,156,087 | B2 | 10/2015 | Cooper | |
| 9,205,490 | B2 | 12/2015 | Cooper | |
| 9,328,615 | B2 | 5/2016 | Cooper | |
| 2001/0000465 | A1 | 4/2001 | Thut | |
| 2002/0146313 | A1 | 10/2002 | Thut | |
| 2002/0185794 | A1 | 12/2002 | Vincent | |
| 2003/0047850 | A1 | 3/2003 | Areaux | |
| 2003/0075844 | A1 | 4/2003 | Mordue et al. | |
| 2003/0082052 | A1 | 5/2003 | Gilbert et al. | |
| 2003/0201583 | A1 | 10/2003 | Klingensmith | |
| 2004/0050525 | A1 | 3/2004 | Kennedy et al. | |
| 2004/0076533 | A1 | 4/2004 | Cooper | |
| 2004/0115079 | A1 | 6/2004 | Cooper | |
| 2004/0262825 | A1 | 12/2004 | Cooper | |
| 2005/0013713 | A1 | 1/2005 | Cooper | |
| 2005/0013714 | A1 | 1/2005 | Cooper | |
| 2005/0013715 | A1 | 1/2005 | Cooper | |
| 2005/0053499 | A1 | 3/2005 | Cooper | |
| 2005/0077730 | A1 | 4/2005 | Thut | |
| 2005/0116398 | A1 | 6/2005 | Tremblay | |
| 2006/0180963 | A1 | 8/2006 | Thut | |
| 2007/0253807 | A1 | 11/2007 | Cooper | |
| 2008/0213111 | A1 | 9/2008 | Cooper | |
| 2008/0230966 | A1 | 9/2008 | Cooper | |
| 2008/0253905 | A1 | 10/2008 | Morando et al. | |
| 2008/0304970 | A1 | 12/2008 | Cooper | |
| 2008/0314548 | A1 | 12/2008 | Cooper | |
| 2009/0054167 | A1 | 2/2009 | Cooper | |
| 2009/0269191 | A1 | 10/2009 | Cooper | |
| 2010/0104415 | A1* | 4/2010 | Morando | 415/1 |
| 2011/0142603 | A1 | 6/2011 | Cooper | |
| 2011/0142606 | A1 | 6/2011 | Cooper | |
| 2011/0148012 | A1 | 6/2011 | Cooper | |
| 2011/0163486 | A1 | 7/2011 | Cooper | |
| 2011/0210232 | A1 | 9/2011 | Cooper | |
| 2011/0220771 | A1 | 9/2011 | Cooper | |
| 2011/0303706 | A1 | 12/2011 | Cooper | |
| 2012/0003099 | A1 | 1/2012 | Tetkoskie | |
| 2012/0163959 | A1* | 6/2012 | Morando | 415/122.1 |
| 2013/0105102 | A1 | 5/2013 | Cooper | |
| 2013/0142625 | A1 | 6/2013 | Cooper | |
| 2013/0214014 | A1 | 8/2013 | Cooper | |
| 2013/0224038 | A1 | 8/2013 | Tetkoskie | |
| 2013/0292426 | A1* | 11/2013 | Cooper et al. | 222/590 |
| 2013/0292427 | A1* | 11/2013 | Cooper | 222/594 |
| 2013/0299524 | A1* | 11/2013 | Cooper et al. | 222/590 |
| 2013/0299525 | A1* | 11/2013 | Cooper et al. | 222/590 |
| 2013/0306687 | A1 | 11/2013 | Cooper | |
| 2013/0334744 | A1 | 12/2013 | Tremblay et al. | |
| 2013/0343904 | A1 | 12/2013 | Cooper | |
| 2014/0041252 | A1 | 2/2014 | Vild et al. | |
| 2014/0044520 | A1 | 2/2014 | Tipton | |
| 2014/0083253 | A1 | 3/2014 | Lutes et al. | |
| 2014/0210144 | A1 | 7/2014 | Torres et al. | |
| 2014/0232048 | A1 | 8/2014 | Howitt et al. | |
| 2014/0252701 | A1 | 9/2014 | Cooper | |
| 2014/0261800 | A1 | 9/2014 | Cooper | |
| 2014/0265068 | A1 | 9/2014 | Cooper | |
| 2014/0271219 | A1 | 9/2014 | Cooper | |
| 2014/0363309 | A1 | 12/2014 | Henderson et al. | |
| 2015/0192364 | A1 | 7/2015 | Cooper | |
| 2015/0217369 | A1 | 8/2015 | Cooper | |
| 2015/0219111 | A1 | 8/2015 | Cooper | |
| 2015/0219112 | A1 | 8/2015 | Cooper | |
| 2015/0219113 | A1 | 8/2015 | Cooper | |
| 2015/0219114 | A1 | 8/2015 | Cooper | |
| 2015/0224574 | A1 | 8/2015 | Cooper | |
| 2015/0252807 | A1 | 9/2015 | Cooper | |
| 2015/0285557 | A1 | 10/2015 | Cooper | |
| 2015/0285558 | A1 | 10/2015 | Cooper | |
| 2015/0323256 | A1 | 11/2015 | Cooper | |
| 2015/0328682 | A1 | 11/2015 | Cooper | |
| 2015/0328683 | A1 | 11/2015 | Cooper | |
| 2016/0031007 | A1 | 2/2016 | Cooper | |
| 2016/0040265 | A1 | 2/2016 | Cooper | |
| 2016/0047602 | A1 | 2/2016 | Cooper | |
| 2016/0053762 | A1 | 2/2016 | Cooper | |
| 2016/0053814 | A1 | 2/2016 | Cooper | |
| 2016/0082507 | A1 | 3/2016 | Cooper | |
| 2016/0089718 | A1 | 3/2016 | Cooper | |
| 2016/0091251 | A1 | 3/2016 | Cooper | |

FOREIGN PATENT DOCUMENTS

| | | |
|---|---|---|
| CA | 2244251 | 12/1996 |
| CA | 2305865 | 2/2000 |
| CA | 2176475 | 7/2005 |
| CH | 392268 | 9/1965 |
| DE | 1800446 | 12/1969 |
| EP | 0168250 | 1/1986 |
| EP | 0665378 | 2/1995 |
| EP | 1019635 | 6/2006 |
| GB | 942648 | 11/1963 |
| GB | 1185314 | 3/1970 |
| GB | 2217784 | 3/1989 |
| JP | 58048796 | 3/1983 |
| JP | 63104773 | 5/1988 |
| JP | 05112837 | 5/1993 |
| MX | 227385 | 4/2005 |
| NO | 90756 | 1/1959 |
| RU | 416401 | 2/1974 |
| RU | 773312 | 10/1980 |
| WO | WO9808990 | 3/1998 |
| WO | WO9825031 | 6/1998 |
| WO | WO0009889 | 2/2000 |
| WO | WO0212147 | 2/2002 |
| WO | WO2004029307 | 4/2004 |
| WO | 2014055082 | 4/2014 |
| WO | 2014150503 | 9/2014 |
| WO | 2014185971 | 11/2014 |

OTHER PUBLICATIONS

USPTO; Notice of Reissue Examination Certificate dated Aug. 27, 2001 in U.S. Appl. No. 90/005,910.

"Response to Final Office Action and Request for Continued Examination for U.S. Appl. No. 09/275,627," Including Declarations of Haynes and Johnson, Apr. 16, 2001.

Document No. 504217: Excerpts from "Pyrotek Inc.'s Motion for Summary Judgment of Invalidity and Unenforceability of U.S. Pat. No. 7,402,276," Oct. 2, 2009.

Document No. 505026: Excerpts from "MMEI's Response to Pyrotek's Motion for Summary Judgment of Invalidity or Enforceability of U.S. Pat. No. 7,402,276," Oct. 9, 2009.

Document No. 507689: Excerpts from "MMEI's Pre-Hearing Brief and Supplemental Motion for Summary Judgment of Infringement of Claims 3-4, 15, 17-20, 26 and 28-29 of the '074 Patent and Motion for Reconsideration of the Validity of Claims 7-9 of the '276 Patent," Nov. 4, 2009.

(56) References Cited

OTHER PUBLICATIONS

Document No. 517158: Excerpts from "Reasoned Award," Feb. 19, 2010.
Document No. 525055: Excerpts from "Molten Metal Equipment Innovations, Inc.'s Reply Brief in Support of Application to Confirm Arbitration Award and Opposition to Motion to Vacate," May 12, 2010.
USPTO; Office Action dated Feb. 23, 1996 in U.S. Appl. No. 08/439,739.
USPTO; Office Action dated Aug. 15, 1996 in U.S. Appl. No. 08/439,739.
USPTO; Advisory Action dated Nov. 18, 1996 in U.S. Appl. No. 08/439,739.
USPTO; Advisory Action dated Dec. 9, 1996 in U.S. Appl. No. 08/439,739.
USPTO; Notice of Allowance dated Jan. 17, 1997 in U.S. Appl. No. 08/439,739.
USPTO; Office Action dated Jul. 22, 1996 in U.S. Appl. No. 08/489,962.
USPTO; Office Action dated Jan. 6, 1997 in U.S. Appl. No. 08/489,962.
USPTO; Interview Summary dated Mar. 4, 1997 in U.S. Appl. No. 08/489,962.
USPTO; Notice of Allowance dated Mar. 27, 1997 in U.S. Appl. No. 08/489,962.
USPTO; Office Action dated Sep. 23, 1998 in U.S. Appl. No. 08/759,780.
USPTO; Interview Summary dated Dec. 30, 1998 in U.S. Appl. No. 08/789,780.
USPTO; Notice of Allowance dated Mar. 17, 1999 in U.S. Appl. No. 08/789,780.
USPTO; Office Action dated Jul. 23, 1998 in U.S. Appl. No. 08/889,882.
USPTO; Office Action dated Jan. 21, 1999 in U.S. Appl. No. 08/889,882.
USPTO; Notice of Allowance dated Mar. 17, 1999 in U.S. Appl. No. 08/889,882.
USPTO; Office Action dated Feb. 26, 1999 in U.S. Appl. No. 08/951,007.
USPTO; Interview Summary dated Mar. 15, 1999 in U.S. Appl. No. 08/951,007.
USPTO; Office Action dated May 17, 1999 in U.S. Appl. No. 08/951,007.
USPTO; Notice of Allowance dated Aug. 27, 1999 in U.S. Appl. No. 08/951,007.
USPTO; Office Action dated Dec. 23, 1999 in U.S. Appl. No. 09/132,934.
USPTO; Notice of Allowance dated Mar. 9, 2000 in U.S. Appl. No. 09/132,934.
USPTO; Office Action dated Jan. 7, 2000 in U.S. Appl. No. 09/152,168.
USPTO; Notice of Allowance dated Aug. 7, 2000 in U.S. Appl. No. 09/152,168.
USPTO; Office Action dated Sep. 29, 1999 in U.S. Appl. No. 09/275,627.
USPTO; Office Action dated May 22, 2000 in U.S. Appl. No. 09/275,627.
USPTO; Office Action dated Nov. 14, 2000 in U.S. Appl. No. 09/275,627.
USPTO; Office Action dated May 21, 2001 in U.S. Appl. No. 09/275,627.
USPTO; Notice of Allowance dated Aug. 31, 2001 in U.S. Appl. No. 09/275,627.
USPTO; Office Action dated Jun. 15, 2000 in U.S. Appl. No. 09/312,361.
USPTO; Notice of Allowance dated Jan. 29, 2001 in U.S. Appl. No. 09/312,361.
USPTO; Office Action dated Jun. 22, 2001 in U.S. Appl. No. 09/569,461.
USPTO; Office Action dated Oct. 12, 2001 in U.S. Appl. No. 09/569,461.
USPTO; Office Action dated May 3, 2002 in U.S. Appl. No. 09/569,461.
USPTO; Advisory Action dated May 14, 2002 in U.S. Appl. No. 09/569,461.
USPTO; Office Action dated Dec. 4, 2002 in U.S. Appl. No. 09/569,461.
USPTO; Interview Summary dated Jan. 14, 2003 in U.S. Appl. No. 09/569,461.
USPTO; Notice of Allowance dated Jun. 24, 2003 in U.S. Appl. No. 09/569,461.
USPTO; Office Action dated Nov. 21, 2000 in U.S. Appl. No. 09/590,108.
USPTO; Office Action dated May 22, 2001 in U.S. Appl. No. 09/590,108.
USPTO; Notice of Allowance dated Sep. 10, 2001 in U.S. Appl. No. 09/590,108.
USPTO; Office Action dated Jan. 30, 2002 in U.S. Appl. No. 09/649,190.
USPTO; Office Action dated Oct. 4, 2002 in U.S. Appl. No. 09/649,190.
USPTO; Office Action dated Apr. 18, 2003 in U.S. Appl. No. 09/649,190.
USPTO; Notice of Allowance dated Nov. 21, 2003 in U.S. Appl. No. 09/649,190.
USPTO; Office Action dated Jun. 7, 2006 in U.S. Appl. No. 10/619,405.
USPTO; Final Office Action dated Feb. 20, 2007 in U.S. Appl. No. 10/619,405.
USPTO; Office Action dated Oct. 9, 2007 in U.S. Appl. No. 10/619,405.
USPTO; Final Office Action dated May 29, 2008 in U.S. Appl. No. 10/619,405.
USPTO; Interview Summary Aug. 22, 2008 in U.S. Appl. No. 10/619,405.
USPTO; Ex Parte Quayle dated Sep. 12, 2008 in U.S. Appl. No. 10/619,405.
USPTO; Interview Summary dated Oct. 16, 2008 in U.S. Appl. No. 10/619,405.
USPTO; Notice of Allowance dated Nov. 14, 2008 in U.S. Appl. No. 10/619,405.
USPTO; Office Action dated Mar. 20, 2006 in U.S. Appl. No. 10/620,318.
USPTO; Office Action dated Nov. 16, 2006 in U.S. Appl. No. 10/620,318.
USPTO; Final Office Action dated Jul. 25, 2007 in U.S. Appl. No. 10/620,318.
USPTO; Office Action dated Feb. 12, 2008 in U.S. Appl. No. 10/620,318.
USPTO; Final Office Action dated Oct. 16, 2008 in U.S. Appl. No. 10/620,318.
USPTO; Office Action dated Feb. 25, 2009 in U.S. Appl. No. 10/620,318.
USPTO; Final Office Action dated Oct. 8, 2009 in U.S. Appl. No. 10/620,318.
USPTO; Notice of Allowance Jan. 26, 2010 in U.S. Appl. No. 10/620,318.
USPTO; Office Action dated Nov. 15, 2007 in U.S. Appl. No. 10/773,101.
USPTO; Office Action dated Jun. 27, 2006 in U.S. Appl. No. 10/773,102.
USPTO; Final Office Action dated Mar. 6, 2007 in U.S. Appl. No. 10/773,102.
USPTO; Office Action dated Oct. 11, 2007 in U.S. Appl. No. 10/773,102.
USPTO; Interview Summary dated Mar. 18, 2008 in U.S. Appl. No. 10/773,102.
USPTO; Notice of Allowance dated Apr. 18, 2008 in U.S. Appl. No. 10/773,102.
USPTO; Office Action dated Jul. 24, 2006 in U.S. Appl. No. 10/773,105.

(56) References Cited

OTHER PUBLICATIONS

USPTO; Office Action dated Oct. 9, 2007 in U.S. Appl. No. 10/773,105.
USPTO; Interview Summary dated Jan. 25, 2008 in U.S. Appl. No. 10/773,105.
USPTO; Office Action dated May 19, 2008 in U.S. Appl. No. 10/773,105.
USPTO; Interview Summary dated Jul. 21, 2008 in U.S. Appl. No. 10/773,105.
USPTO; Notice of Allowance dated Sep. 29, 2008 in U.S. Appl. No. 10/773,105.
USPTO; Office Action dated Jan. 31, 2008 in U.S. Appl. No. 10/773,118.
USPTO; Final Office Action dated Aug. 18, 2008 in U.S. Appl. No. 10/773,118.
USPTO; Interview Summary dated Oct. 16, 2008 in U.S. Appl. No. 10/773,118.
USPTO; Office Action dated Dec. 15, 2008 in U.S. Appl. No. 10/773,118.
USPTO; Final Office Action dated May 1, 2009 in U.S. Appl. No. 10/773,118.
USPTO; Office Action dated Jul. 27, 2009 in U.S. Appl. No. 10/773,118.
USPTO; Final Office Action dated Feb. 2, 2010 in U.S. Appl. No. 10/773,118.
USPTO; Interview Summary dated Jun. 4, 2010 in U.S. Appl. No. 10/773,118.
USPTO; Ex Parte Quayle Action dated Aug. 25, 2010 in U.S. Appl. No. 10/773,118.
USPTO; Notice of Allowance dated Nov. 5, 2010 in U.S. Appl. No. 10/773,118.
USPTO; Office Action dated Mar. 16, 2005 in U.S. Appl. No. 10/827,941.
USPTO; Final Office Action dated Nov. 7, 2005 in U.S. Appl. No. 10/827,941.
USPTO; Office Action dated Jul. 12, 2006 in U.S. Appl. No. 10/827,941.
USPTO; Final Office Action dated Mar. 8, 2007 in U.S. Appl. No. 10/827,941.
USPTO; Office Action dated Oct. 29, 2007 in U.S. Appl. No. 10/827,941.
USPTO; Office Action dated Sep. 26, 2008 in U.S. Appl. No. 11/413,982.
USPTO; Office Action dated Dec. 11, 2009 in U.S. Appl. No. 11/766,617.
USPTO; Office Action dated Mar. 8, 2010 in U.S. Appl. No. 11/766,617.
USPTO; Final Office Action dated Sep. 20, 2010 in U.S. Appl. No. 11/766,617.
USPTO; Office Action dated Mar. 1, 2011 in U.S. Appl. No. 11/766,617.
USPTO; Final Office Action dated Sep. 22, 2011 in U.S. Appl. No. 11/766,617.
USPTO; Office Action dated Jan. 27, 2012 in U.S. Appl. No. 11/766,617.
USPTO; Notice of Allowance dated May 15, 2012 in U.S. Appl. No. 11/766,617.
USPTO; Supplemental Notice of Allowance dated Jul. 31, 2012 in U.S. Appl. No. 11/766,617.
USPTO; Notice of Allowance dated Aug. 24, 2012 in U.S. Appl. No. 11/766,617.
USPTO; Final Office Action dated Oct. 14, 2008 in U.S. Appl. No. 12/111,835.
USPTO; Office Action dated May 15, 2009 in U.S. Appl. No. 12/111,835.
USPTO; Office Action dated Mar. 31, 2009 in U.S. Appl. No. 12/120,190.
USPTO; Final Office Action dated Dec. 4, 2009 in U.S. Appl. No. 12/120,190.
USPTO; Office Action dated Jun. 28, 2010 in U.S. Appl. No. 12/120,190.
USPTO; Final Office Action dated Jan. 6, 2011 in U.S. Appl. No. 12/120,190.
USPTO; Office Action dated Jun. 27, 2011 in U.S. Appl. No. 12/120,190.
USPTO; Final Office Action dated Nov. 28, 2011 in U.S. Appl. No. 12/120,190.
USPTO; Notice of Allowance dated Feb. 6, 2012 in U.S. Appl. No. 12/120,190.
USPTO; Office Action dated Nov. 3, 2008 in U.S. Appl. No. 12/120,200.
USPTO; Final Office Action dated May 28, 2009 in U.S. Appl. No. 12/120,200.
USPTO; Office Action dated Dec. 18, 2009 in U.S. Appl. No. 12/120,200.
USPTO; Final Office Action dated Jul. 9, 2010 in U.S. Appl. No. 12/120,200.
USPTO; Office Action dated Jan. 21, 2011 in U.S. Appl. No. 12/120,200.
USPTO; Final Office Action dated Jul. 26, 2011 in U.S. Appl. No. 12/120,200.
USPTO; Final Office Action dated Feb. 3, 2012 in U.S. Appl. No. 12/120,200.
USPTO; Notice of Allowance dated Jan. 17, 2013 in U.S. Appl. No. 12/120,200.
USPTO; Office Action dated Jun. 16, 2009 in U.S. Appl. No. 12/146,770.
USPTO; Final Office Action dated Feb. 24, 2010 in U.S. Appl. No. 12/146,770.
USPTO; Office Action dated Jun. 9, 2010 in U.S. Appl. No. 12/146,770.
USPTO; Office Action dated Nov. 18, 2010 in U.S. Appl. No. 12/146,770.
USPTO; Final Office Action dated Apr. 4, 2011 in U.S. Appl. No. 12/146,770.
USPTO; Notice of Allowance dated Aug. 22, 2011 in U.S. Appl. No. 12/146,770.
USPTO; Notice of Allowance dated Nov. 1, 2011 in U.S. Appl. No. 12/146,770.
USPTO; Office Action dated Apr. 27, 2009 in U.S. Appl. No. 12/146,788.
USPTO; Final Office Action dated Oct. 15, 2009 in U.S. Appl. No. 12/146,788.
USPTO; Office Action dated Feb. 16, 2010 in U.S. Appl. No. 12/146,788.
USPTO; Final Office Action dated Jul. 13, 2010 in U.S. Appl. No. 12/146,788.
USPTO; Office Action dated Apr. 19, 2011 in U.S. Appl. No. 12/146,788.
USPTO; Notice of Allowance dated Aug. 19, 2011 in U.S. Appl. No. 12/146,788.
USPTO; Office Action dated Apr. 13, 2009 in U.S. Appl. No. 12/264,416.
USPTO; Final Office Action dated Oct. 8, 2009 in U.S. Appl. No. 12/264,416.
USPTO; Office Action dated Feb. 1, 2010 in U.S. Appl. No. 12/264,416.
USPTO; Final Office Action dated Jun. 30, 2010 in U.S. Appl. No. 12/264,416.
USPTO; Office Action dated Mar. 17, 2011 in U.S. Appl. No. 12/264,416.
USPTO; Final Office Action dated Jul. 7, 2011 in U.S. Appl. No. 12/264,416.
USPTO; Office Action dated Nov. 4, 2011 in U.S. Appl. No. 12/264,416.
USPTO; Final Office Action dated Jun. 8, 2012 in U.S. Appl. No. 12/264,416.
USPTO; Office Action dated Nov. 28, 2012 in U.S. Appl. No. 12/264,416.
USPTO; Ex Parte Quayle dated Apr. 3, 2013 in U.S. Appl. No. 12/264,416.

(56) References Cited

OTHER PUBLICATIONS

USPTO; Notice of Allowance dated Jun. 23, 2013 in U.S. Appl. No. 12/264,416.
USPTO; Office Action dated May 22, 2009 in U.S. Appl. No. 12/369,362.
USPTO; Final Office Action dated Dec. 14, 2009 in U.S. Appl. No. 12/369,362.
USPTO; Final Office Action dated Jun. 11, 2010 in U.S. Appl. No. 12/395,430.
USPTO; Office Action dated Nov. 24, 2010 in U.S. Appl. No. 12/395,430.
USPTO; Final Office Action dated Apr. 6, 2011 in U.S. Appl. No. 12/395,430.
USPTO; Office Action dated Aug. 18, 2011 in U.S. Appl. No. 12/395,430.
USPTO; Final Office Action dated Dec. 13, 2011 in U.S. Appl. No. 12/395,430.
USPTO; Advisory Action dated Feb. 22, 2012 in U.S. Appl. No. 12/395,430.
USPTO; Notice of Allowance dated Sep. 20, 2012 in U.S. Appl. No. 12/395,430.
USPTO; Office Action dated Sep. 29, 2010 in U.S. Appl. No. 12/758,509.
USPTO; Final Office Action dated May 11, 2011 in U.S. Appl. No. 12/758,509.
USPTO; Office Action dated Feb. 1, 2012 in U.S. Appl. No. 12/853,201.
USPTO; Final Office Action dated Jul. 3, 2012 in U.S. Appl. No. 12/853,201.
USPTO; Notice of Allowance dated Jan. 31, 2013 in U.S. Appl. No. 12/853,201.
USPTO; Office Action dated Jan. 3, 2013 in U.S. Appl. No. 12/853,238.
USPTO; Office Action dated Dec. 18, 2013 in U.S. Appl. No. 12/853,238.
USPTO; Final Office Action dated May 19, 2014 in U.S. Appl. No. 12/853,238.
USPTO; Office Action dated Feb. 27, 2012 in U.S. Appl. No. 12/853,253.
USPTO; Ex Parte Quayle Action dated Jun. 27, 2012 in U.S. Appl. No. 12/853,253.
USPTO; Notice of Allowance dated Oct. 2, 2012 in U.S. Appl. No. 12/853,253.
USPTO; Office Action dated Mar. 12, 2012 in U.S. Appl. No. 12/853,255.
USPTO; Final Office Action dated Jul. 24, 2012 in U.S. Appl. No. 12/853,255.
USPTO; Office Action dated Jan. 18, 2013 in U.S. Appl. No. 12/853,255.
USPTO; Notice of Allowance dated Jun. 20, 2013 in U.S. Appl. No. 12/853,255.
USPTO; Office Action dated Apr. 19, 2012 in U.S. Appl. No. 12/853,268.
USPTO; Final Office Action dated Sep. 17, 2012 in U.S. Appl. No. 12/853,268.
USPTO; Notice of Allowance dated Nov. 21, 2012 in U.S. Appl. No. 12/853,268.
USPTO; Office Action dated May 29, 2012 in U.S. Appl. No. 12/878,984.
USPTO; Office Action dated Oct. 3, 2012 in U.S. Appl. No. 12/878,984.
USPTO; Final Office Action dated Jan. 25, 2013 in U.S. Appl. No. 12/878,984.
USPTO; Notice of Allowance dated Mar. 28, 2013 in U.S. Appl. No. 12/878,984.
USPTO; Office Action dated Sep. 22, 2011 i238n U.S. Appl. No. 12/880,027.
USPTO; Final Office Action dated Feb. 16, 2012 in U.S. Appl. No. 12/880,027.
USPTO; Office Action dated Dec. 14, 2012 in U.S. Appl. No. 12/880,027.
USPTO; Final Office Action dated Jul. 11, 2013 in U.S. Appl. No. 12/880,027.
USPTO; Office Action dated Jul. 16, 2014 in U.S. Appl. No. 12/880,027.
USPTO; Office Action dated Dec. 18, 2013 in U.S. Appl. No. 12/895,796.
USPTO; Final Office Action dated Jun. 3, 2014 in U.S. Appl. No. 12/895,796.
USPTO; Office Action dated Nov. 17, 2014 in U.S. Appl. No. 12/895,796.
USPTO; Office Action dated Aug. 25, 2011 in U.S. Appl. No. 13/047,719.
USPTO; Final Office Action dated Dec. 16, 2011 in U.S. Appl. No. 13/047,719.
USPTO; Office Action dated Sep. 11, 2012 in U.S. Appl. No. 13/047,719.
USPTO; Notice of Allowance dated Feb. 28, 2013 in U.S. Appl. No. 13/047,719.
USPTO; Office Action dated Aug. 25, 2011 in U.S. Appl. No. 13/047,747.
USPTO; Final Office Action dated Feb. 7, 2012 in U.S. Appl. No. 13/047,747.
USPTO; Notice of Allowance dated Apr. 18, 2012 in U.S. Appl. No. 13/047,747.
USPTO; Office Action dated Dec. 13, 2012 in U.S. Appl. No. 13/047,747.
USPTO; Notice of Allowance dated Apr. 3, 2013 in U.S. Appl. No. 13/047,747.
USPTO; Office Action dated Apr. 12, 2013 in U.S. Appl. No. 13/106,853.
USPTO; Notice of Allowance dated Aug. 23, 2013 in U.S. Appl. No. 13/106,853.
USPTO; Office Action dated Apr. 18, 2012 in U.S. Appl. No. 13/252,145.
USPTO; Final Office Action dated Sep. 17, 2012 in U.S. Appl. No. 13/252,145.
USPTO; Notice of Allowance dated Nov. 30, 2012 in U.S. Appl. No. 13/252,145.
USPTO; Office Action dated Aug. 1, 2013 in U.S. Appl. No. 12/877,988.
USPTO; Notice of Allowance dated Dec. 24, 2013 in U.S. Appl. No. 12/877,988.
USPTO; Office Action dated Sep. 6, 2013 in U.S. Appl. No. 13/725,383.
USPTO; Office Action dated Oct. 24, 2013 in U.S. Appl. No. 13/725,383.
USPTO; Final Office Action dated Mar. 25, 2014 in U.S. Appl. No. 13/725,383.
USPTO; Office Action dated Sep. 18, 2012 in U.S. Appl. No. 13/752,312.
USPTO; Final Office Action dated Jan. 27, 2014 in U.S. Appl. No. 13/752,312.
USPTO; Final Office Action dated May 23, 2014 in U.S. Appl. No. 13/752,312.
USPTO; Office Action dated Sep. 11, 2013 in U.S. Appl. No. 13/756,468.
USPTO; Notice of Allowance dated Feb. 3, 2014 in U.S. Appl. No. 13/756,468.
USPTO; Office Action dated Aug. 14, 2014 in U.S. Appl. No. 13/791,889.
USPTO; Office Action dated Sep. 10, 2014 in U.S. Appl. No. 13/843,947.
USPTO; Office Action dated Sep. 15, 2014 in U.S. Appl. No. 13/797,616.
USPTO; Restriction Requirement dated Sep. 17, 2014 in U.S. Appl. No. 13/801,907.
USPTO; Restriction Requirement dated Sep. 17, 2014 in U.S. Appl. No. 13/802,203.
USPTO; Office Action dated Sep. 22, 2014 in U.S. Appl. No. 13/830,031.

(56) References Cited

OTHER PUBLICATIONS

USPTO; Office Action dated Sep. 25, 2014 in U.S. Appl. No. 13/838,601.
USPTO; Notice of Allowance dated Dec. 17, 2014 in U.S. Appl. No. 13/752,312.
USPTO; Office Action dated Sep. 10, 2014 in U.S. Appl. No. 13/791,952.
USPTO; Office Action dated Sep. 23, 2014 in U.S. Appl. No. 13/843,947.
USPTO; Office Action dated Nov. 28, 2014 in U.S. Appl. No. 13/843,947.
USPTO; Final Office Action dated Dec. 5, 2014 in U.S. Appl. No. 13/791,889.
USPTO; Final Office Action dated Dec. 9, 2014 in U.S. Appl. No. 13/801,907.
USPTO; Office Action dated Jan. 9, 2015 in U.S. Appl. No. 13/802,040.
USPTO; Office Action dated Dec. 11, 2014 in U.S. Appl. No. 13/802,203.
USPTO; Ex Parte Quayle Office Action dated Dec. 19, 2014 in U.S. Appl. No. 12/880,027.
USPTO; Notice of Allowance dated Jan. 30, 2015 in U.S. Appl. No. 13/830,031.
USPTO; Office Action dated Feb. 13, 215 in U.S. Appl. No. 13/973,962.
USPTO; Office Action dated Mar. 3, 2015 in U.S. Appl. No. 13/725,383.
USPTO; Final Office Action dated Mar. 3, 2015 in U.S. Appl. No. 13/838,601.
CIPO; Office Action dated Dec. 4, 2001 in U.S. Pat. No. 2,115,929.
CIPO; Office Action dated Apr. 22, 2002 in U.S. Pat. No. 2,115,929.
CIPO; Notice of Allowance dated Jul. 18, 2003 in U.S. Pat. No. 2,115,929.
CIPO; Office Action dated Jun. 30, 2003 in U.S. Pat. No. 2,176,475.
CIPO; Notice of Allowance dated Sep. 15, 2004 in U.S. Pat. No. 2,176,475.
CIPO; Office Action dated May 29, 2000 in U.S. Pat. No. 2,242,174.
CIPO; Office Action dated Feb. 22, 2006 in U.S. Pat. No. 2,244,251.
CIPO; Office Action dated Mar. 27, 2007 in U.S. Pat. No. 2,244,251.
CIPO; Office Action dated Sep. 18, 2002 in U.S. Pat. No. 2,305,865.
CIPO; Notice of Allowance dated May 2, 2003 in U.S. Pat. No. 2,305,865.
EPO; Examination Report dated Oct. 6, 2008 in Application No. 08158682.
EPO; Office Action dated Jan. 26, 2010 in Application No. 08158682.
EPO; Office Action dated Feb. 15, 2011 in Application No. 08158682.
EPO; Search Report dated Nov. 9, 1998 in Application No. 98112356.
EPO; Office Action dated Feb. 6, 2003 in Application No. 99941032.
EPO; Office Action dated Aug. 20, 2004 in Application No. 99941032.
PCT; International Search Report or Declaration dated Nov. 15, 1999 in Application No. PCT/US1999/18178.
PCT; International Search Report or Declaration dated Oct. 9, 1998 in Application No. PCT/US1999/22440.
USPTO; Office Action dated Mar. 31, 2015 in U.S. Appl. No. 12/853,238.
USPTO; Office Action dated Jan. 20, 2016 in U.S. Appl. No. 12/853,238.
USPTO; Notice of Allowance dated Apr. 8, 2015 in U.S. Appl. No. 12/880,027.
USPTO; Office Action dated Sep. 1, 2015 in U.S. Appl. No. 12/895,796.
USPTO; Office Action dated Nov. 20, 2015 in U.S. Appl. No. 13/725,383.
USPTO; Office Action dated Dec. 15, 2015 in U.S. Appl. No. 13/800,460.
USPTO; Office Action dated Jul. 24, 2015 in U.S. Appl. No. 13/838,601.
USPTO; Notice of Allowance dated Jun. 5, 2015 in U.S. Appl. No. 13/801,907.
USPTO; Supplemental Notice of Allowance dated Oct. 2, 2015 in U.S. Appl. No. 13/801,907.
USPTO; Notice of Allowance dated Jul. 14, 2015 in U.S. Appl. No. 13/802,040.
USPTO; Office Action dated Jan. 12, 2016 in U.S. Appl. No. 13/802,203.
USPTO; Office Action dated Apr. 10, 2015 in U.S. Appl. No. 14/027,237.
USPTO; Notice of Allowance dated Jan. 15, 2016 in U.S. Appl. No. 14/027,237.
USPTO; Notice of Allowance dated Nov. 24, 2015 in U.S. Appl. No. 13/973,962.
USPTO; Final Office Action dated Aug. 20, 2015 in U.S. Appl. No. 14/027,237.
USPTO; Ex Parte Quayle Action dated Nov. 4, 2015 in U.S. Appl. No. 14/027,237.
USPTO; Restriction Requirement dated Jun. 25, 2015 in U.S. Appl. No. 13/841,938.
USPTO; Office Action dated Aug. 25, 2015 in U.S. Appl. No. 13/841,938.
USPTO; Final Office Action dated Jul. 10, 2015 in U.S. Appl. No. 12/853,238.
USPTO; Final Office Action dated Jul. 10, 2015 in U.S. Appl. No. 13/725,383.
USPTO; Office Action dated Jul. 30, 2015 in U.S. Appl. No. 13/841,594.
USPTO; Final Office Action dated Feb. 23, 2016 in U.S. Appl. No. 13/841,594.
USPTO; Office Action dated Dec. 17, 2015 in U.S. Appl. No. 14/286,442.
USPTO; Office Action dated Dec. 23, 2015 in U.S. Appl. No. 14/662,100.
USPTO; Office Action dated Dec. 14, 2015 in U.S. Appl. No. 14/687,806.
USPTO; Office Action dated Dec. 18, 2015 in U.S. Appl. No. 14/689,879.
USPTO; Office Action dated Dec. 15, 2015 in U.S. Appl. No. 14/690,064.
USPTO; Office Action dated Dec. 31, 2015 in U.S. Appl. No. 14/690,099.
USPTO; Office Action dated Jan. 4, 2016 in U.S. Appl. No. 14/712,435.
USPTO; Office Action dated Feb. 11, 2016 in U.S. Appl. No. 14/690,174.
USPTO; Office Action dated Feb. 25, 2016 in U.S. Appl. No. 13/841,938.
USPTO; Notice of Allowance dated Mar. 8, 2016 in U.S. Appl. No. 13/973,962.
USPTO; Office Action dated Mar. 10, 2016 in U.S. Appl. No. 14/690,218.
USPTO; Notice of Allowance dated Apr. 11, 2016 in U.S. Appl. No. 14/690,064.
USPTO; Notice of Allowance dated Apr. 12, 2016 in U.S. Appl. No. 14/027,237.
USPTO; Final Office Action dated May 2, 2016 in U.S. Appl. No. 14/687,806.
USPTO; Office action dated May 4, 2016 in U.S. Appl. No. 14/923,296.
USPTO; Notice of Allowance dated May 6, 2016 in U.S. Appl. No. 13/725,383.
USPTO; Notice of Allowance dated May 8, 2016 in U.S. Appl. No. 13/802,203.
USPTO; Office Action dated May 9, 2016 in U.S. Appl. No. 14/804,157.
USPTO; Office Action dated May 19, 2016 in U.S. Appl. No. 14/745,845.
USPTO; Office Action dated Jun. 6, 2016 in U.S. Appl. No. 14/808,935.

* cited by examiner

SECTION A-A

SECTION B-B

SECTION C-C

SECTION A-A

DETAIL C

DETAIL D

VESSEL TRANSFER INSERT AND SYSTEM

CROSS-REFERENCE TO RELATED APPLICATIONS

This application is a continuation-in-part of, and claims priority to U.S. patent application Ser. No. 13/797,616 (Now U.S. Pat. No. 9,017,597), filed on Mar. 12, 2013, by Paul V. Cooper, is a continuation-in-part of, and claims priority to U.S. application Ser. No. 13/801,907 (Now U.S. Pat. No. 9,205,490), filed on Mar. 13, 2013, by Paul V. Cooper, is a continuation-in-part of, and claims priority to U.S. patent application Ser. No. 13/802,040 (Now U.S. Pat. No. 9,156,087), filed on Mar. 13, 2013, by Paul V. Cooper, and is a continuation-in-part of and claims priority to U.S. patent application Ser. No. 13/802,203, filed on Mar. 13, 2013, by Paul V. Cooper, the disclosure(s) of which that is not inconsistent with the present disclosure is incorporated herein by reference. This application is also a continuation-in-part of, and claims priority to U.S. patent application Ser. No. 13/106,853 (Now U.S. Pat. No. 8,613,884), filed May 12, 2011, by Paul V. Cooper, which is a continuation-in-part of U.S. patent application Ser. No. 12/853,253 (Now U.S. Pat. No. 8,366,993), filed Aug. 9, 2010 by Paul V. Cooper, filed on Aug. 9, 2010, by Paul V. Cooper and U.S. patent application Ser. No. 11/766,617 (Now U.S. Pat. No. 8,337,746), by Paul V. Cooper, filed on Jun. 21, 2007, the disclosure(s) of which that is not inconsistent with the present disclosure is incorporated herein by reference. This application also claims priority to U.S. Provisional Patent Application Ser. No. 61/334,146, filed May 12, 2010, by Paul V. Cooper, the disclosure of which that is not inconsistent with the present disclosure is incorporated herein by reference

FIELD OF THE INVENTION

The invention relates to an insert for placing in a vessel to assist in transferring molten metal out of the vessel, and to a system utilizing the insert in combination with a molten metal pump.

BACKGROUND OF THE INVENTION

As used herein, the term "molten metal" means any metal or combination of metals in liquid form, such as aluminum, copper, iron, zinc and alloys thereof. The term "gas" means any gas or combination of gases, including argon, nitrogen, chlorine, fluorine, freon, and helium, that are released into molten metal.

Known molten-metal pumps include a pump base (also called a housing or casing), one or more inlets (an inlet being an opening in the housing to allow molten metal to enter a pump chamber), a pump chamber, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber and is connected to a drive system. The drive system is typically an impeller shaft connected to one end of a drive shaft, the other end of the drive shaft being connected to a motor. Often, the impeller shaft is comprised of graphite, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber.

A number of submersible pumps used to pump molten metal (referred to herein as molten metal pumps) are known in the art. For example, U.S. Pat. No. 2,948,524 to Sweeney et al U.S. Pat. No. 4,169,584 to Mangalick, U.S. Pat. No. 5,203,681 to Cooper, U.S. Pat. No. 6,093,000 to Cooper and U.S. Pat. No. 6,123,523 to Cooper, and U.S. Pat. No. 6,303,074 to Cooper, all disclose molten metal pumps. The disclosures of the patents to Cooper noted above are incorporated herein by reference. The term submersible means that when the pump is in use, its base is at least partially submerged in a bath of molten metal.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Most often, circulation pumps are used in a reverbatory furnace having an external well. The well is usually an extension of the charging well where scrap metal is charged (i.e., added).

Transfer pumps are generally used to transfer molten metal from the external well of a reverbatory furnace to a different location such as a ladle or another furnace.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used fix either of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a metal-transfer conduit extending from the discharge, or into a stream of molten metal exiting either the discharge or the metal-transfer conduit. Alternatively, gas may be released into the pump chamber or upstream of the pump chamber at a position where molten metal enters the pump chamber.

Generally, a degasser (also called a rotary degasser) includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the connector of the impeller. Examples of rotary degassers are disclosed in U.S. Pat. No. 4,898,367 entitled "Dispersing Gas Into Molten Metal," U.S. Pat. No. 5,678,807 entitled "Rotary Degassers," and U.S. Pat. No. 6,689,310 to Cooper entitled "Molten Metal Degassing Device and Impellers Therefore," filed May 12, 2000, the respective disclosures of which are incorporated herein by reference.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon) or carbon-based material, excluding graphite, capable of being used in the environment of a molten metal bath. "Graphite" means any type of graphite, whether or not chemically treated. Graphite is particularly suitable for being formed into pump components because it is (a) soft and relatively easy to machine, (b) not as brittle as ceramics and less prone to breakage, and (c) less expensive than ceramics.

Generally a scrap melter includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is preferably used in conjunction with the scrap melter to circulate the molten metal in order to maintain a relatively constant temperature within the molten metal. Scrap melters are disclosed in U.S. Pat. No. 4,598,899 to Cooper, U.S. patent application Ser. No. 09/649,190 to Cooper, filed Aug. 28, 2000, and U.S. Pat. No. 4,930,986 to Cooper, the respective disclosures of which are incorporated herein by reference.

SUMMARY OF THE INVENTION

The invention is an insert that is positioned in a vessel in order to assist in the transfer of molten metal out of the vessel. In one embodiment, the insert is an enclosed structure defining a cavity and having a first opening in the bottom half of its side and a second opening at the top. The insert further includes a launder structure (or trough) positioned at its top. Molten metal is forced into the first opening and raises the level of molten metal in the cavity until the molten metal passes through the second opening and into the launder structure, where it passes out of the vessel.

The insert can also be created by attaching or forming a secondary wall to a wall of the vessel, thus creating a cavity between the two walls. A first opening is formed in the secondary wall and a launder structure is positioned, or formed, at the top of the secondary wall and the wall of the vessel, so that a second opening is formed at the top. Molten metal is forced into the first opening and raises the level of molten metal in the cavity until the molten metal passes through the second opening and into the launder structure, where it passes out of the vessel.

A system according to the invention utilizes an insert and a molten metal pump, which is preferably a circulation pump, but could be a gas-injection (or gas-release) pump, to force (or move) molten metal through the first opening and into the cavity of the insert.

Another system according to aspects of the invention includes a pump and a refractory casing that houses the pump. As the pump operates it moves molten metal upward through an uptake section of the casing until it reaches an outlet wherein it exits the vessel. The outlet may be attached to a launder. Another system uses a wall to divide a cavity of the chamber into two portions. The wall has an opening and a pump pumps molten metal from a first portion into a second portion until the level in the second portion reaches an outlet and exits the vessel.

DETAILED DESCRIPTION OF PREFERRED EMBODIMENTS

Figure 1:
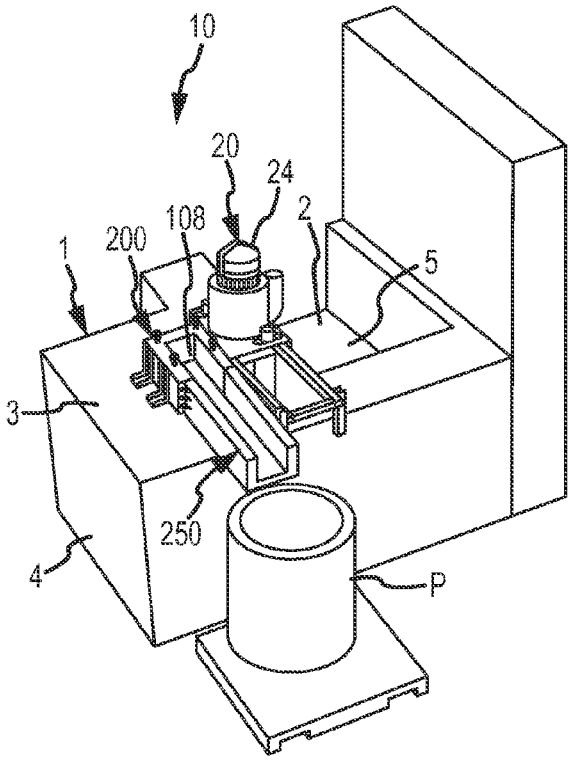
FIG. 1 is a top, perspective view of a system according to the invention, wherein the system is installed in a vessel designed to contain molten metal.
Figure 1A:
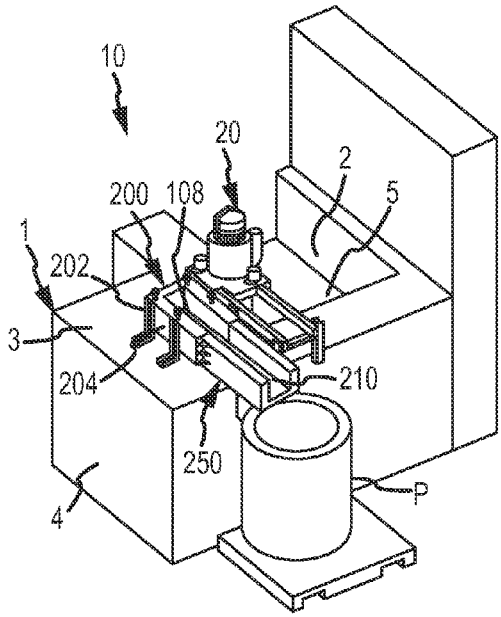
FIG. 1A is another top, perspective view of a system according to FIG. 1.

Turning now to the drawings, where the purpose is to describe a preferred embodiment of the invention and not to limit same, a system and insert according to the invention will be described. FIGS. 1-3 and 7 show a system 10 according to an aspect of the invention, and a vessel 1. Vessel 1 has a well 2, a top surface 3, a side surface 4, a floor 5, and a vessel well 6.

System 10 comprises a molten metal pump 20 and an insert 100. Pump 20 is preferably a circulation pump and can be any type of circulation pump satisfactory to move molten metal into the insert as described herein. The structure of circulator pumps is know to those skilled in the art and one preferred pump for use with the invention is called "The Mini," manufactured by Molten Metal Equipment Innovations, Inc. of Middlefield, Ohio 44062, although any suitable pump may be used. The pump 20 preferably has a superstructure 22, a drive source 24 (which is most preferably a pneumatic motor) mounted on the superstructure 22, support posts 26, a drive shaft 28, and a pump base 30. The support posts 26 connect the superstructure 22 to the base 30 in order to support the superstructure 22.

Drive shaft 28 preferably includes a motor drive shaft (not shown) that extends downward from the motor and that is preferably comprised of steel, a rotor drive shaft 32, that is preferably comprised of graphite, or graphite coated with a ceramic, and a coupling (not shown) that connects the motor drive shaft to end 32B of rotor drive shaft 32.

Figure 5:
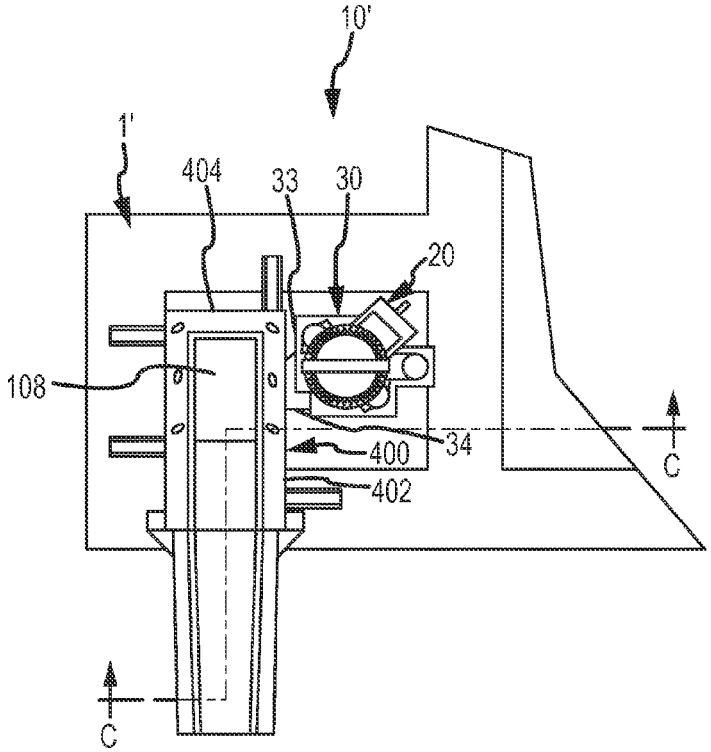
FIG. 5 is a top view of the system of FIG. 4.
Figure 9:
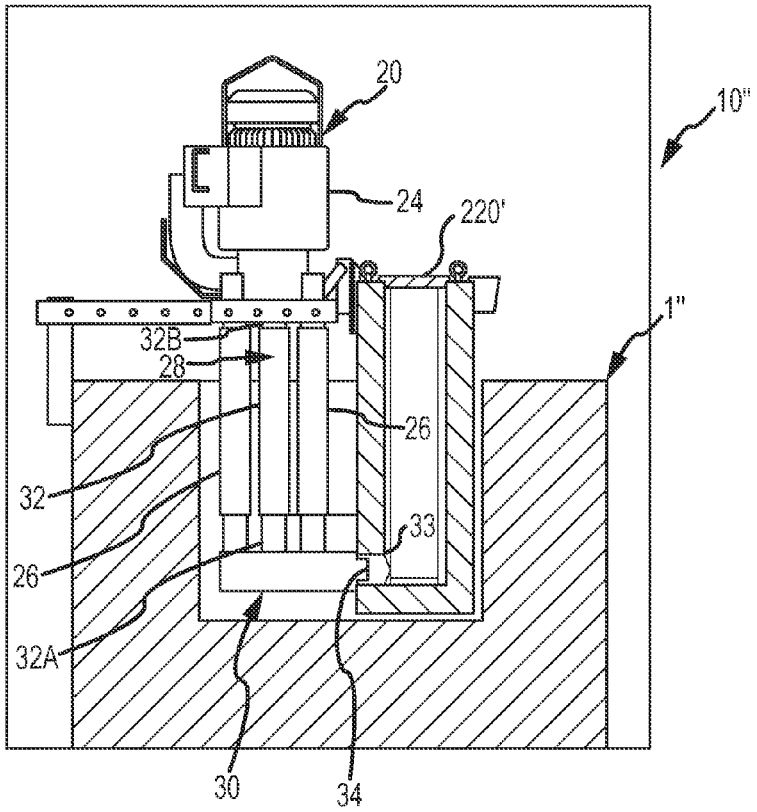
FIG. 9 is a partial sectional view of the system of FIG. 8 taken along line A-A.
Figure 10:
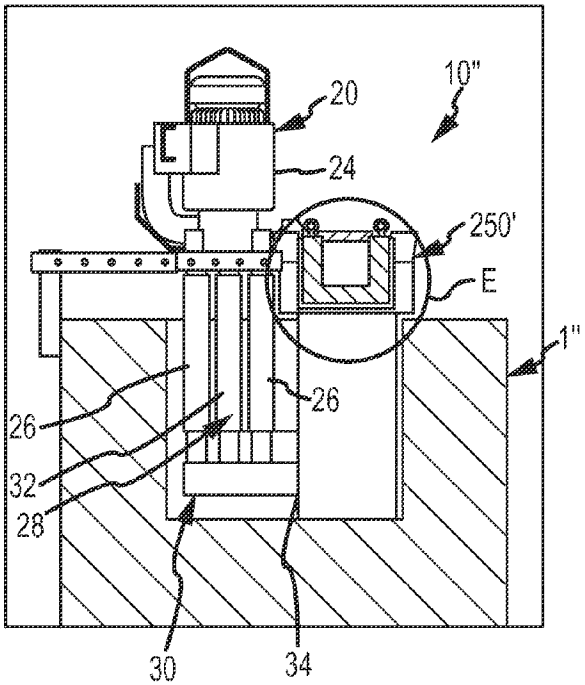
FIG. 10 is a partial sectional view of the system of FIG. 8 taken along line B-B.

The pump base 30 includes an inlet (not shown) at the top and/or bottom of the pump base, wherein the inlet is an opening that leads to a pump chamber (not shown), which is a cavity formed in the pump base. The pump chamber is connected to a tangential discharge, which is known in art, that leads to an outlet, which is an opening in the side wall 33 of the pump base. In the preferred embodiment, the side wall 33 of the pump base including the outlet has an extension 34 formed therein and the outlet is at the end of the extension. This configuration is shown in FIGS. 5, 9 and 10.

A rotor (not shown) is positioned in the pump chamber and is connected to an end of the rotor shaft 32A that is opposite the end of the rotor shaft 32B, which is connected to the coupling.

In operation, the motor rotates the drive shaft, which rotates the rotor. As the rotor (also called an impeller) rotates, it moves molten metal out of the pump chamber, through the discharge and through the outlet.

An insert 100 according to this aspect of the invention includes (a) an enclosed device 102 that can be placed into vessel well 2, and (b) a trough (or launder section) 200 positioned on top of device 102. Device 102 as shown (and best seen in FIGS. 2-3 and 5) is a generally rectangular structure, but can be of any suitable shape or size, wherein the size depends on the height and volume of the vessel well 3 into which device 102 is positioned. The device 102 and trough 200 are each preferably comprised of material capable of withstanding the heat and corrosive environment when exposed to molten metal (particularly molten aluminum). Most preferably the heat resistant material is a high temperature, castable cement, with a high silicon carbide content, such as ones manufactured by AP Green or Harbison Walker, each of which are part of ANH Refractory, based at 400 Fairway Drive, Moon Township, Pa. 15108, or Allied Materials. The cement is of a type know by those skilled in the art, and is cast in a conventional manner known to those skilled in the art.

Figure 2:
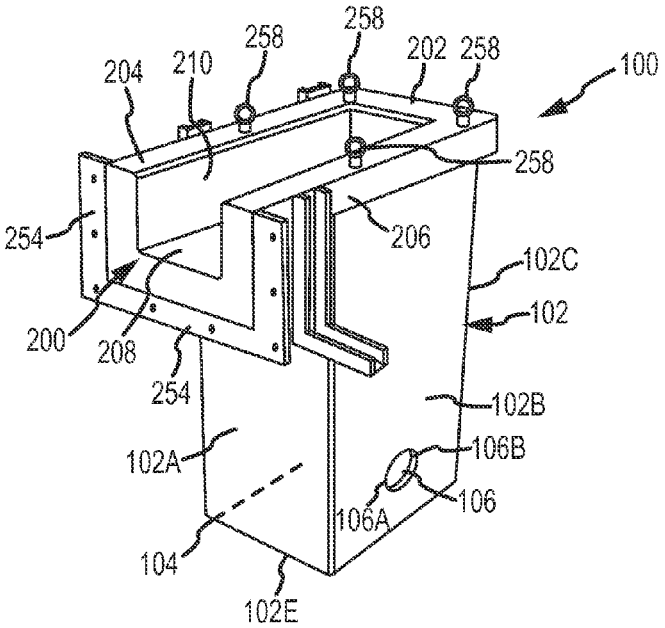
FIG. 2 is a side, perspective view of an insert used with the system of the present invention.
Figure 3:
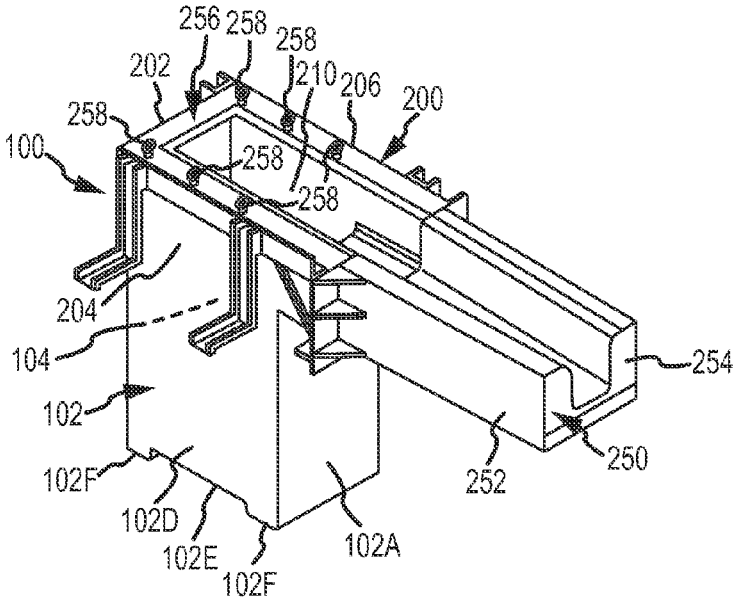
FIG. 3 is a side, perspective view of the insert of FIG. 2 with an extension attached thereto.
Figure 7:
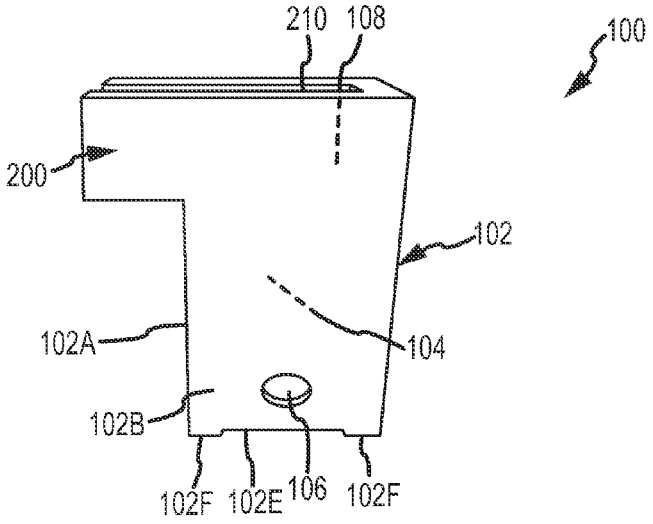
FIG. 7 is a side view of the insert shown in FIG. 2.

Device 102 as shown has four sides 102A, 102B, 102C and 102D, a bottom surface 102E, and an inner cavity 104. Bottom surface 102E may be substantially flat, as shown in FIG. 2, or have one or more supports 102F, as shown in FIGS. 3 and 7.

Side 102B has a first opening 106 formed in its lower half, and preferably no more than 24", or no more than 12", and most preferably no more than 6", from bottom surface 102E. First opening 106 can be of any suitable size and shape, and as shown has rounded sides 106A and 1069. First opening 106 functions to allow molten metal to pass through it and into cavity 104. Most preferably, opening 104 is configured to receive an extension 34 of base 30 of pump 10, as best seen in FIGS. 5, 9 and 10. In these embodiments, the outlet is formed at the end of the extension 34.

Device 102 has a second opening 108 formed in its top. Second opening 108 can be of any suitable size and shape to permit molten metal that enters the cavity 104 to move through the second opening 108 once the level of molten metal in cavity 104 becomes high enough.

Trough 200 is positioned at the top of device 102. Trough 200 has a back wall 202, side walls 204 and 206, and a bottom surface 208. Trough 200 defines a passage 210 through which molten metal can flow once it escapes through second opening 108 in device 102. The bottom surface 208 of trough 200 is preferably angled backwards towards second opening 108, at a preferred angle of 2°-5°, even though any suitable angle could be used. In this manner, any molten metal left in trough 200, once the motor 20 is shut off, will flow backward into opening 108. The bottom surface 208 could, alternatively, be level or be angled forwards away from opening 108. Trough 200 may also have a top cover, which is not shown in this embodiment.

In the embodiment shown in FIGS. 1-3 and 7, the trough 200 at the top of insert 100 is integrally formed with device 102. In a preferred method, after insert 100 is formed, the shape of the launder portion is machined into the top of device 102. Further, part of the front wall 102A is machined away so that trough 200 extends outward from wall 102A, as shown. Trough 200, however, in any embodiment according to the invention, can be formed or created in any suitable manner and could be a separately cast piece attached to device 102.

If trough 200 is a piece separate from device 102, it could be attached to device 102 by metal angle iron and/or brackets (which would preferably made of steel), although any suitable attachment mechanism may be used. Alternatively, or additionally, a separate trough 200 could be cemented to device 200.

An extension 250 is preferably attached to the end of trough 200. Extension 250 preferably has an outer, steel frame 252 about ¼"-⅜" thick and the same refractory cement of which insert 100 is comprised is cast into frame 252 and cured, at a thickness of preferably ¾"-2½", Brackets 260 are preferably welded onto frame 252 and these align with bracket 254 on trough 200. When the holes in brackets 260 align with the holes in bracket 254, bolts or other fasteners can be used to connect the extension 250 to the trough 200. Any suitable fasteners or fastening method, however, may be used. In one embodiment the bracket 254 is formed of ¼" to ⅜" thick angle iron, and brackets 260 are also ¼" to ⅜" thick iron or steel. Preferably, the surfaces of the refractory cement that from the trough and extension that come into contact with the molten metal are coated with boron nitride.

It is preferred that if brackets or metal structures of any type are attached to a piece of refractory material used in any embodiment of the invention, that bosses be placed at the proper positions in the refractory when the refractory piece is cast. Fasteners, such as bolts, are then received in the bosses.

An upper bracket 256 is attached to trough 200. Eyelets 258, which have threaded shafts that are received through upper bracket 256 and into bosses in the refractory (not shown), are used to lift the insert 100 into and out of vessel 1.

Positioning brackets 270 position insert 100 against an inner wall of vessel 1. The size, shape and type of positioning brackets, or other positioning devices, depend on the size and shape of the vessel, and several types of positioning structures could be used for each vessel/insert configuration. The various ones shown here are exemplary only. The positioning structures are usually formed of ⅜" thick steel.

It is also preferred that the pump 20 be positioned such that extension 34 of base 30 is received in the first opening 100. This can be accomplished by simply positioning the pump in the proper position. Further the pump may be head in position by a bracket or clamp that holds the pump against the insert, and any suitable device may be used. For example, a piece of angle iron with holes formed in it may be aligned with a piece of angle iron with holes in it on the insert 100, and bolts could be placed through the holes to maintain the position of the pump 20 relative the insert 100.

In operation, when the motor is activated, molten metal is pumped out of the outlet through first opening 106, and into cavity 104. Cavity 104 fills with molten metal until it reaches the second opening 108, and escapes into the passage 210 of trough 200, where it passes out of vessel 1, and preferably into another vessel, such as the pot P shown, or into ingot molds, or other devices for retaining molten metal. Installation of the insert into a furnace that contains molten metal is preferably accomplished by pre-heating the insert to 300°-400° F. in an oven and then slowly lowering unit into the metal over a period of 1.5 to 2 hours.

Figure 4:
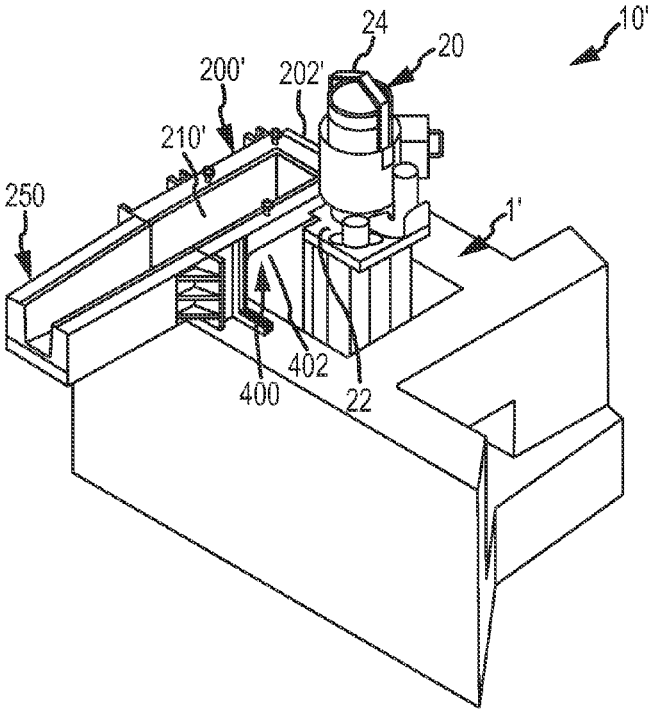
FIG. 4 is a top, perspective view of an alternate system according to the invention.
Figure 6:
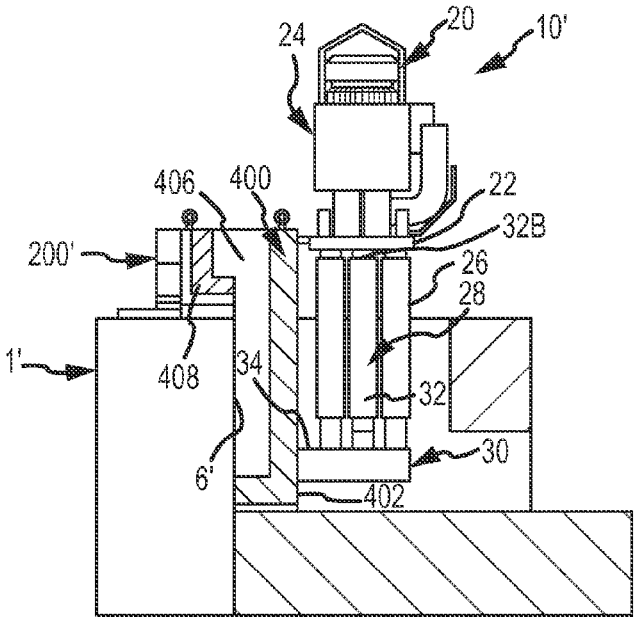
FIG. 6 is a partial, side sectional view of the system shown in FIG. 5 taken along fine C-C.

In another embodiment of the invention shown in FIGS. 4-6, the insert 100 is replaced by a secondary wall 400 positioned in a different vessel, 1', next to vessel wall 6'. Secondary wall 400 has a side surface 402 and a back surface 404 and is attached to vessel wall 7 by any suitable means, such as being separately formed and cemented to it, or being cast onto, or as part of, wall 6'. A cavity 406 is created between the wall 6' of the vessel and secondary wall 400, and there is an opening (not shown) in secondary wall 400 leading to cavity 406. A launder 200' is positioned on top of the cavity 406, and pump 10 is positioned so that its outlet is in fluid communication with the opening in secondary wall 400 so that molten metal will pass through the opening and into the cavity 406 when the pump is in operation. The trough 200 can be formed as a single piece and positioned on top of cavity 402, or it could be formed onto wall 7 along with secondary wall 400. Alternatively, a separate trough wall 408 could be separately formed and attached to the top of wall 6' in such a manner as to seal against with the top surface of wall 6' and the back section 404 of wall 400. In all other respects the system of this embodiment functions in the same manner as the previously described embodiment. This embodiment also includes extension 250 and can use any suitable attachment or positioning devices to position the insert and pump in a desired location in the vessel 1'.

Another embodiment of the invention is shown in FIGS. 8-12. This embodiment is the same as the one shown in FIGS. 1-3 and 7 except for a modification to the insert and the brackets used. This insert is the same as previously described insert 100 except that side 102A is not machined away. So, the trough 200 does not extend past side 102A.

Figure 8:
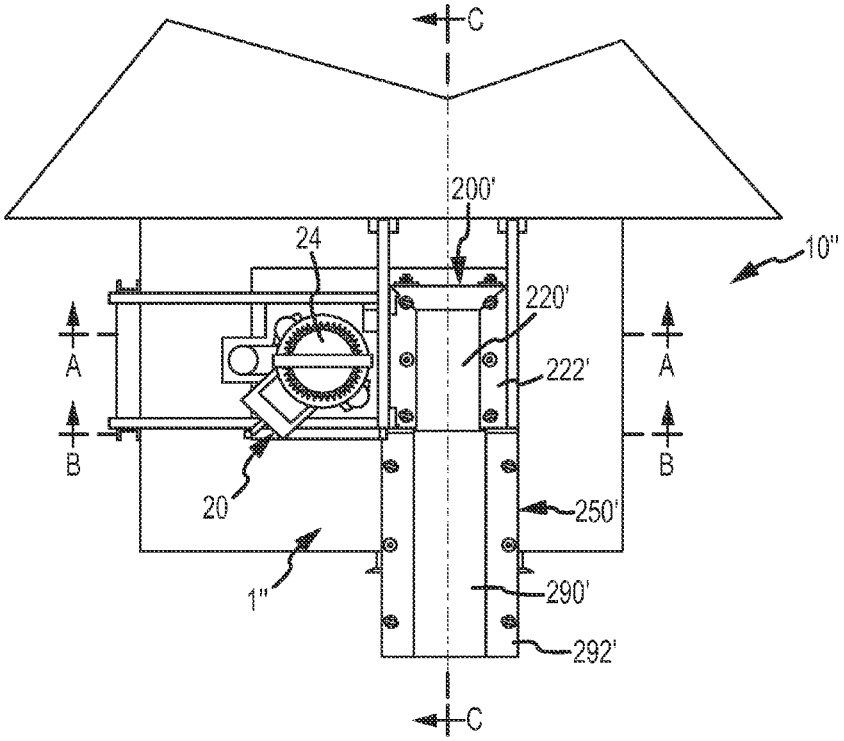
FIG. 8 is a top view of an alternate embodiment of the invention.
Figure 11:
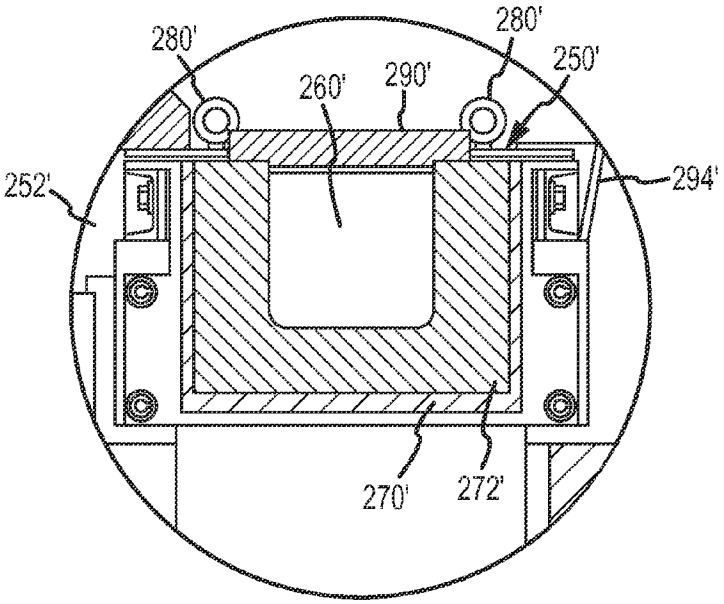
FIG. 11 is a close-up view of Section E of FIG. 10.

FIGS. 8-10 show a bracket structure that hold pump 20 off of the floor of vessel 1" (which has a different configuration than the previously described vessels). FIGS. 8-12, and particularly FIG. 11, show an alternate extension 250'. Extension is 250' formed in the same manner as previously described extension 250, except that it has a layer 270' of insulating concrete between ¼" and 1" thick between the steel outer shell 252' and the cast refractory concrete layer 272'. This type of insulating cement is known to those skilled in the art. Eyelets are included in this embodiment and are received in bosses positioned in the refractory of the extension 250'.

In this embodiment, trough 200' has a top cover 220' held in place by members 222'. Extension 250' has a top cover 290' held in place by members 292'. The purpose of each top cover is to prevent heat from escaping and any suitable structure may be utilized. It is preferred that each top cover 220' and 290' be formed of heat-resistant material, such as refractory cement or graphite, and that members 222' and 292' are made of steel. As shown, a clamp 294' holds member 292' in place, although any suitable attachment mechanism may be used.

Figure 12:
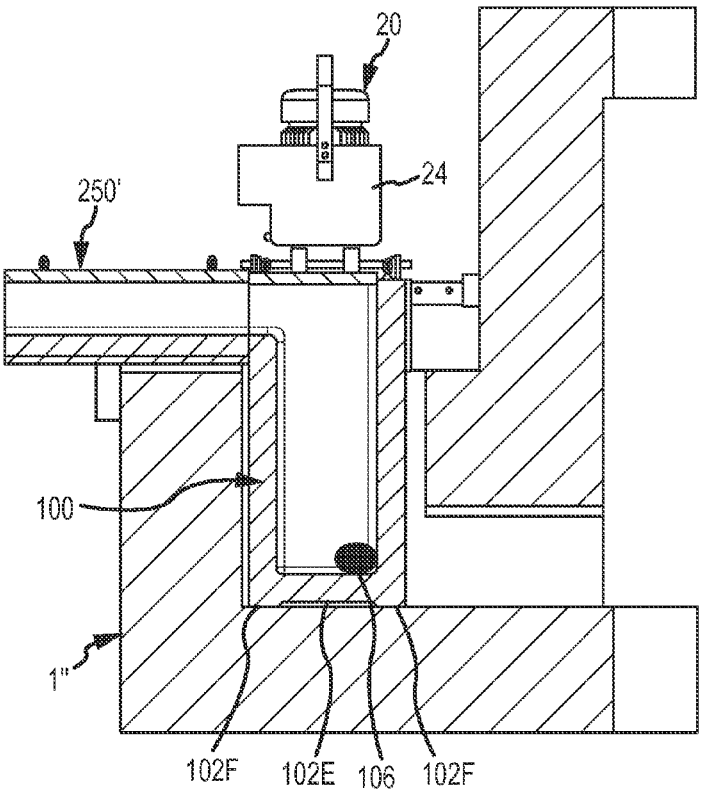
FIG. 12 is a partial sectional view of the system of FIG. 8 taken along line C-C.
Figure 14:
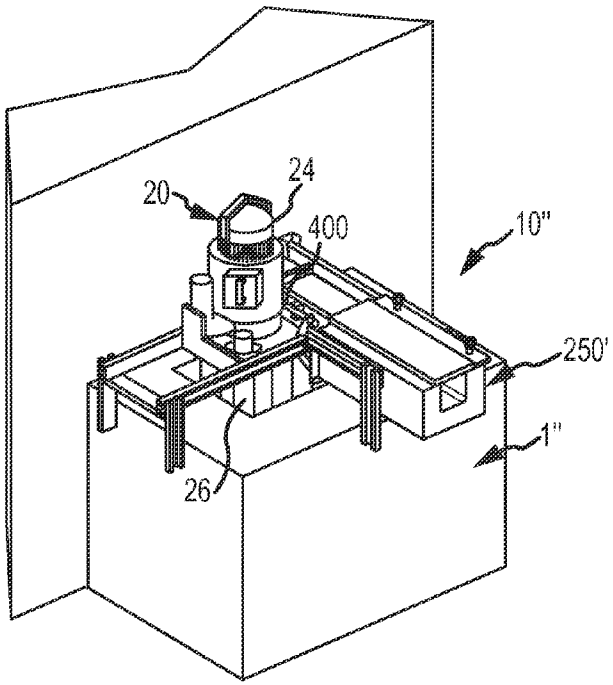
FIG. 14 is a top, perspective view of the system of FIG. 13 positioned in a vessel.
Figure 13:
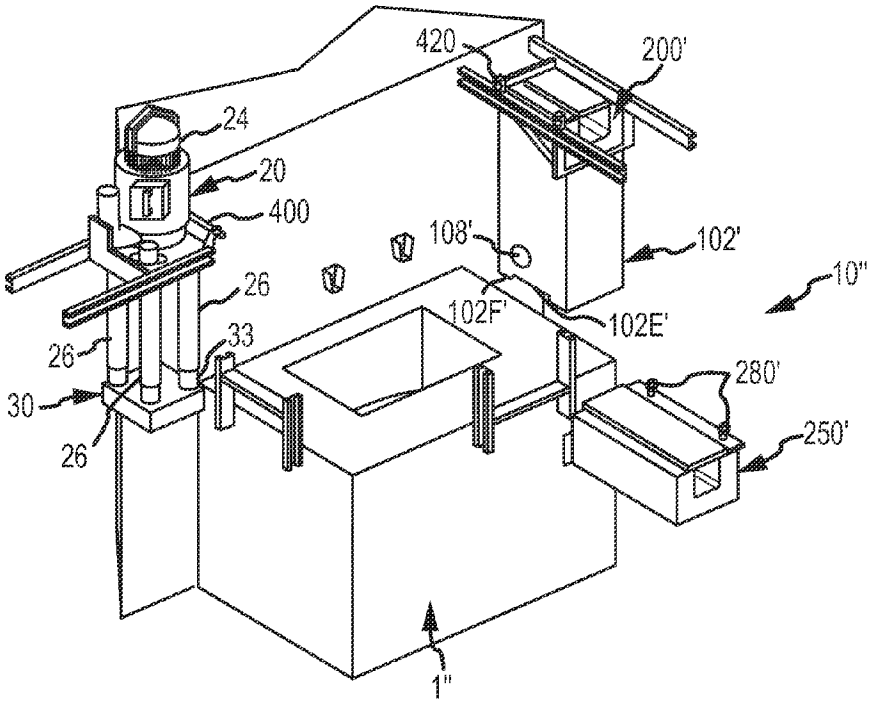
FIG. 13 is an exploded view of the system of FIG. 8 showing an optional bracketing system.
Figure 16:
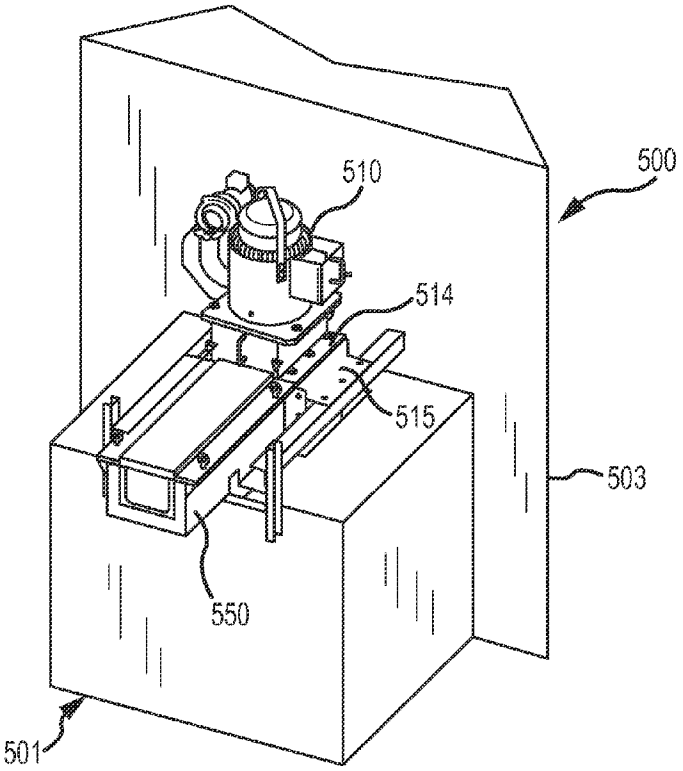
FIG. 16 is an assembled view of the system of FIG. 15.

FIGS. 12 and 13 show the embodiment of the system represented in FIGS. 8-12, with an alternate bracing system to fit the vessel into which the system is being positioned. As previously mentioned, the bracing system is a matter of choice based on the size and shape of the vessel, and different bracing systems could be used for the same application. Another structure for aligning the pump 20 with insert 200' is shown in FIG. 13 bar 400 is received in holders 420.

The support brackets are preferably attached to a steel structure of the furnace to prevent the insert from moving once it is in place. A locating pin on the steel frame allows for alignment of the outlet of the pump with the inlet hole at the bottom.

Figure 15:
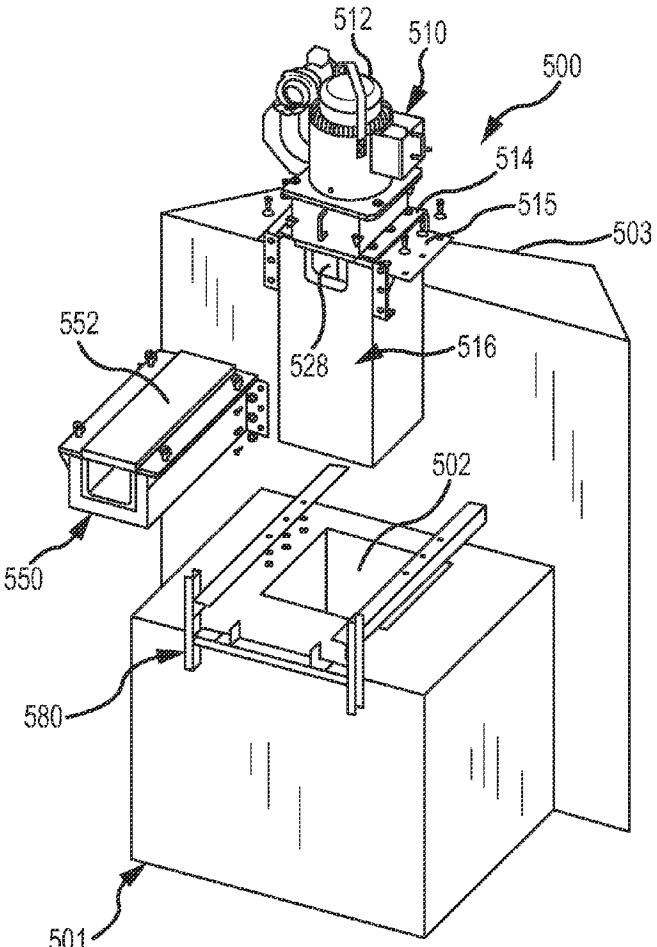
FIG. 15 is a partial, exploded view of an alternate embodiment of a system according to aspects of the invention.
Figure 17:
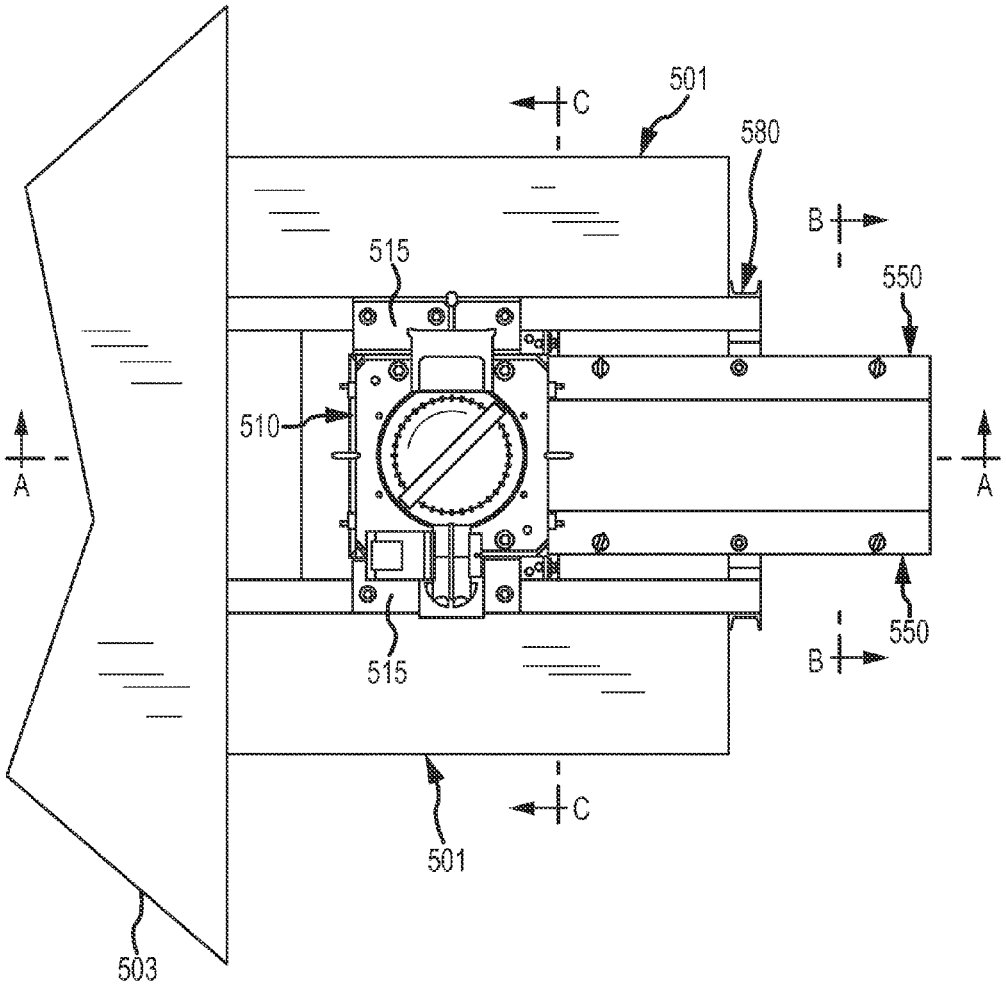
FIG. 17 is a top view of the system of FIG. 16.

FIGS. 15-20 show another embodiment according to aspects of the invention. FIG. 15 is a partial exploded view of a system 500. System 500 includes a pumping device 510, a launder structure 550, and a support structure 580. System 500 fits into the cavity 502 of a vessel 501 that, here, is in fluid communication with a larger vessel of molten metal, which is defined in part by wall 503.

Pumping device 510 includes a motor 512 that rests on a platform 514. Motor 512 can be any suitable type, such as pneumatic or electric. Device 510 also includes a cast housing 516 that acts as a pump chamber and discharge. Cast housing 516 is made of any suitable refractory material and the compositions and methods of making cast housing 516 are known. An advantage of housing 516 is that it can permit system 500 to be placed essentially anywhere in a vessel, and if repairs are required to the pump shaft, rotor or other components, the platform 514 with the motor, shaft and rotor can be disconnected from housing 516 and lifted out vertically. Housing 16 remains in cavity 502, or wherever it has been placed. When the repairs are completed, the pump, rotor shaft and rotor and vertically lowered back into the housing 16 and reconnected to it. Housing 16 is still portable and can be easily moved if desired.

Alternatively, the coupling between the rotor shaft and motor shaft can be disconnected and the rotor shaft and rotor can be removed for repair.

Figure 18:
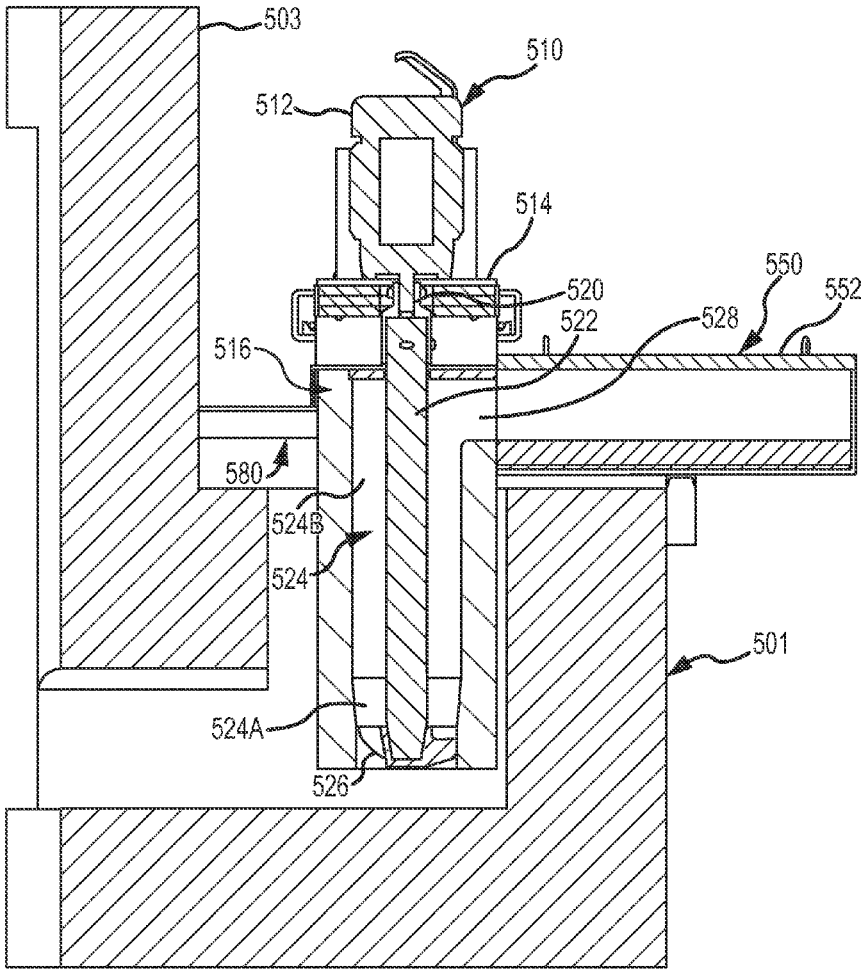
FIG. 18 is a side, partial cross-sectional view of the system of FIG. 17 taken along line A-A.
Figure 19:
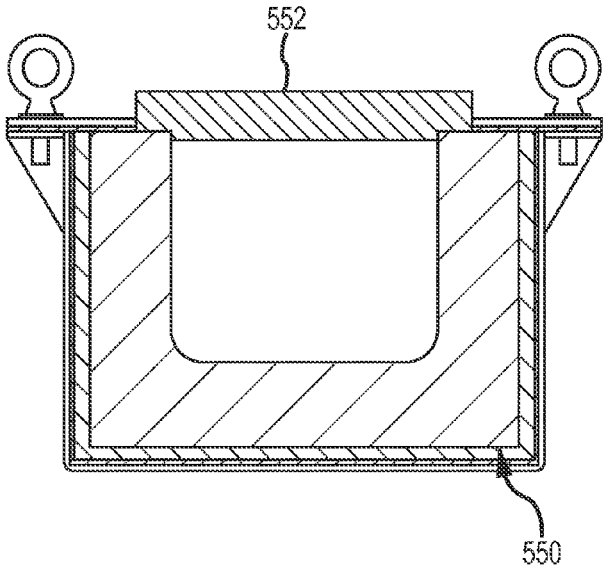
FIG. 19 is a front, cross-sectional view of the launder taken along line B-B of the system of FIG. 17.
Figure 20:
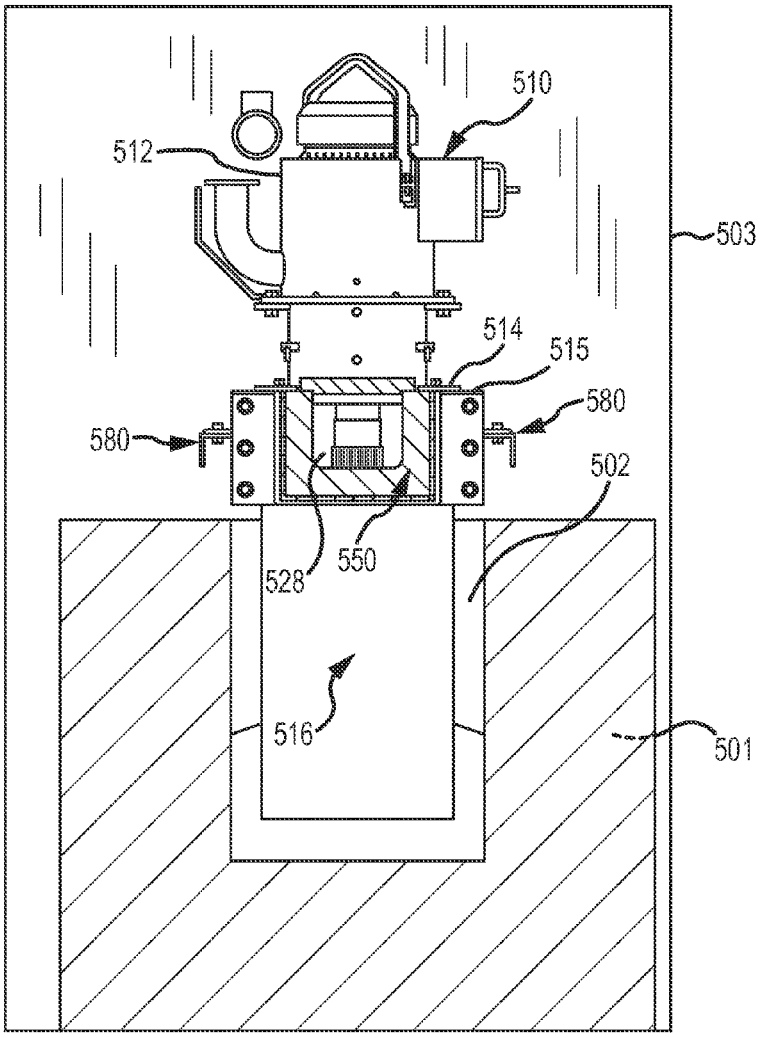
FIG. 20 is a partial, cross-sectional view of the system of FIG. 17 taken along line C-C.
Figure 20A:
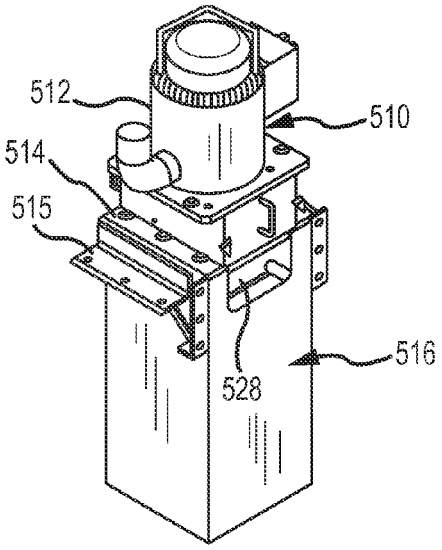
FIGS. 20A-20D show the cast housing of the system of FIG. 15 including the various components as shown in FIG. 15.
Figure 20B:
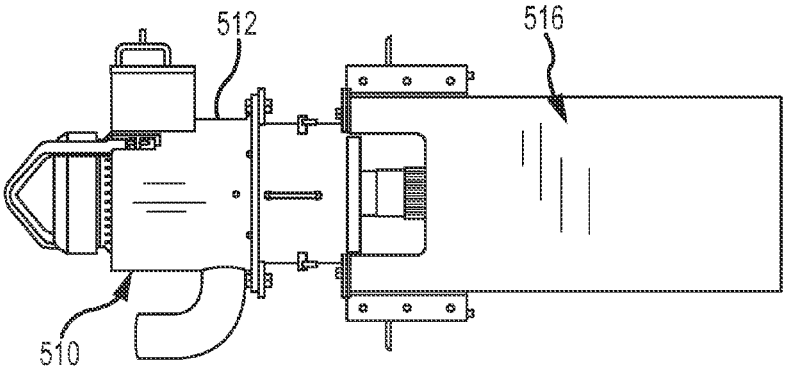
Figure 20C:
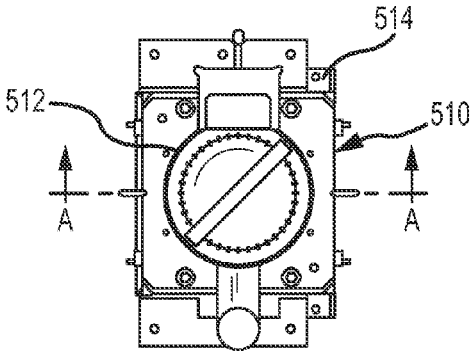
Figure 20D:
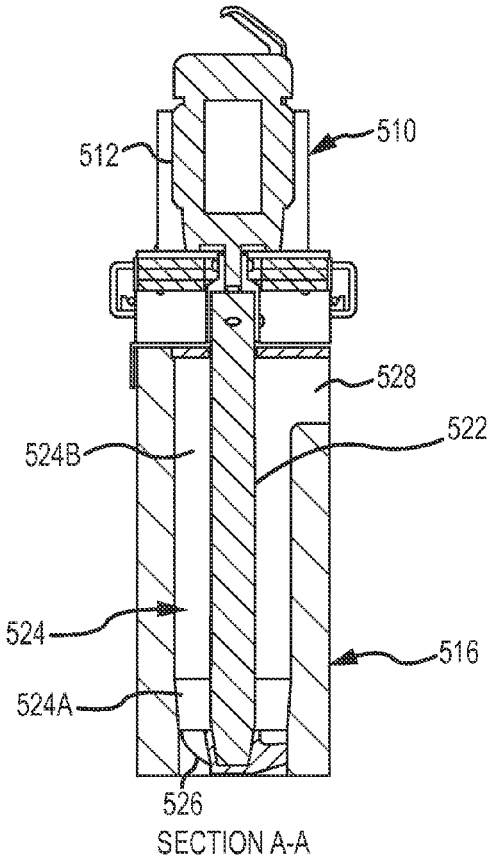

Cast housing 16 as shown has a square or rectangular outer surface. As best seen in FIG. 18, motor 512 has a motor shaft 520 that is connected to a rotor shaft 522, preferably by any suitable coupling. Rotor shaft 522 passes through a vertical transfer chamber, or uptake tube, 524 that has a lower, first portion 524A having a tapered, first cross-sectional area and an upper, second portion 524B having a second cross-sectional area. The first cross-sectional area is smaller than the second cross-sectional area and narrows into an area in which a rotor 526 is received. Rotor 526 is connected in any suitable manner to rotor shaft 522 and when positioned properly in first portion 524A, there is preferably a ¼" or less gap between the outermost part of the rotor and the inner wall of first portion 524A. This is to create sufficient pressure to drive molten metal upward into uptake tube 524, although any suitable dimensions that will achieve this goal may be used.

When molten metal is pushed up the uptake tube 524 it exits through outlet 528 and into launder 550. Launder 550 may be of any suitable design, but is preferably between 1" and 10" deep and may either have an open or closed top, and as shown herein it has a top 552. The launder is preferably formed at a 0° horizontal angle, or at a horizontal angle wherein it tilts back towards outlet 528. Such an angle back towards outlet 528 is preferably 1-10°, 1-5° or 1-3°, or a backward slope of ⅛" for every 10' of launder length.

Motor 510 is retained on housing 16 by metal brackets and any suitable structure will suffice. Launder 550 is fastened into place on housing 16 by metal brackets and fasteners, which are also known in the art, and its weight is preferably supported at least in part by support structure 580 and by the top surface of vessel 501.

As shown support structure 580 is a metal bracket and I-beam structure that fastens to the upper surface of vessel 1 and to brackets 515 extending from motor device 510 and to launder 500 in order to secure system 500 in the proper position.

Figure 21:
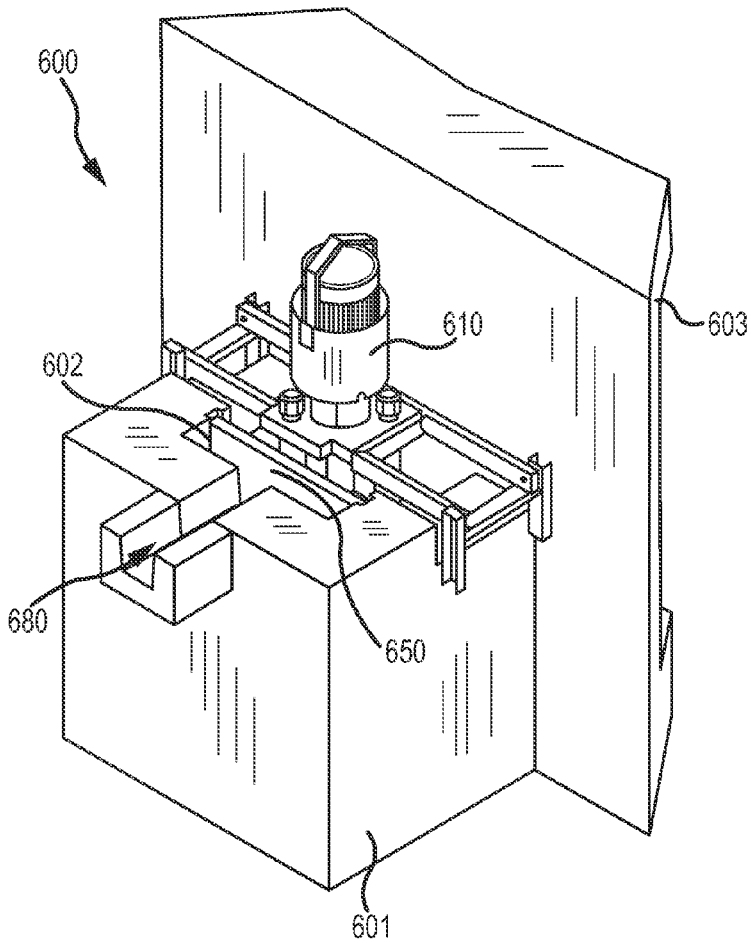
FIG. 21 is a front, perspective view of an alternate system according to aspects of the invention.
Figure 22:
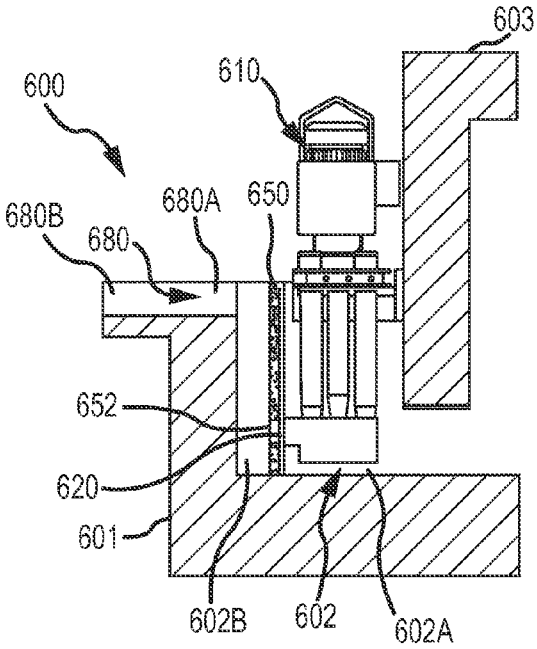
FIG. 22 is a side, partial cross-sectional view of the system of FIG. 21.
Figure 23:
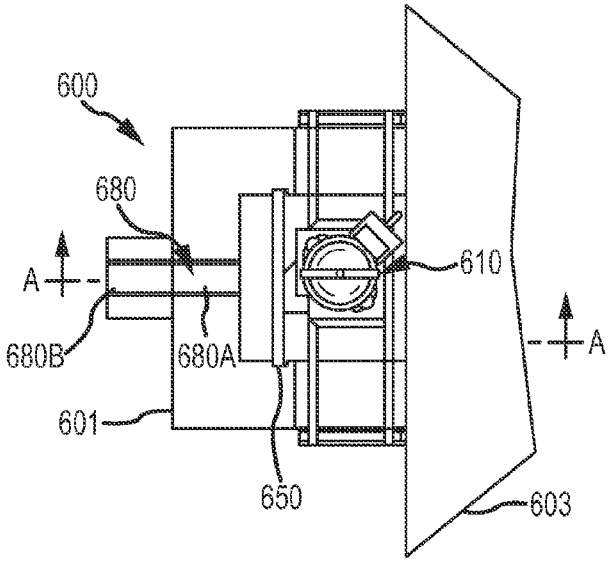
FIG. 23 is a top view of the system of FIG. 21.
Figure 25:
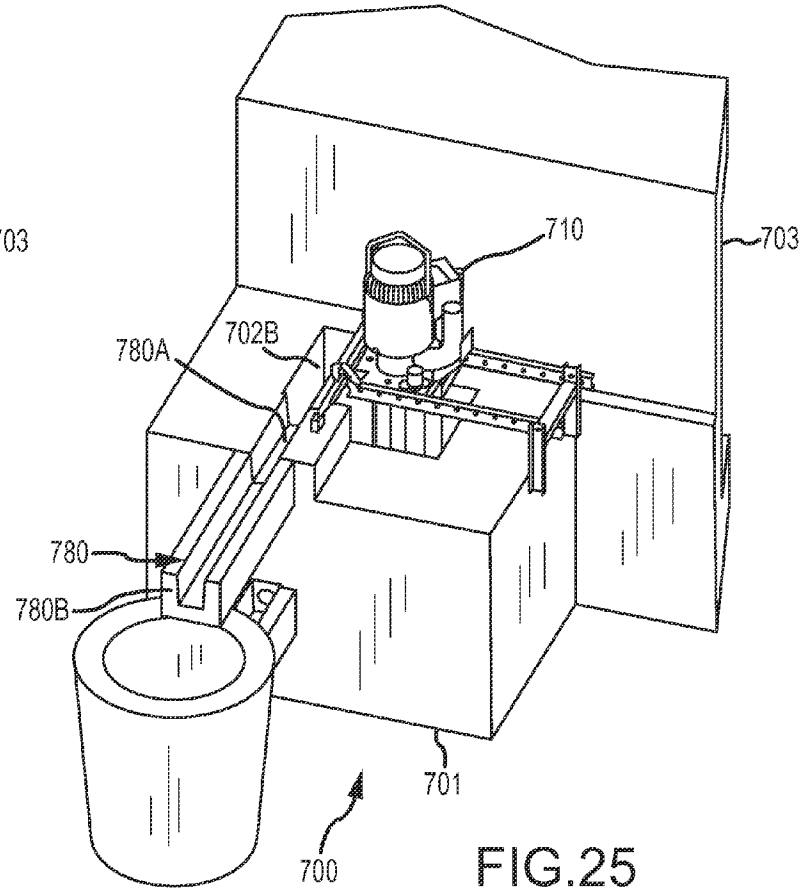
FIG. 25 shows the embodiment of FIG. 24 assembled in a vessel.

FIGS. 21-23 show an embodiment according to other aspects of the invention wherein a pump is mounted in a chamber with a dividing wall as previously described, thereby dividing the vessel into a first chamber and a second chamber, but in this embodiment a launder outlet is built into, and preferably extends from the center of, the vessel containing the pump.

In system 600, vessel 601 is essentially the same as vessel 501, and includes a cavity 602 that receives molten metal from a larger vessel which is defined in part by wall 603. The pump 610 is preferably the same as previously described pump 20, although any suitable pump may be used. Any suitable structures for securing the pump 610 into position as those described in this disclosure, or any other suitable structure, may also be utilized in system 600.

System 600 includes a dividing wall 650 that divides cavity 602 into a first portion 602A and a second portion 602B. Dividing wall 650 includes an opening 652 that is in fluid communication with the pump 610 outlet 620, so as the pump is operated it moves molten metal from portion 602A to portion 602B.

A launder outlet 680 has a portion 680A that is formed in the front wall of vessel 601 and a portion 680B that extends from the front wall of vessel 601, and that is preferably cemented to or cast as part of the front wall of vessel 601.

As motor 610 operates it moves molten metal through the opening 652 and raises the level of molten metal in portion 602B until it reaches launder outlet 680 and exits vessel 601. Wall 650 is high enough to prevent molten metal from spilling over the top and into portion 602A.

Another embodiment of aspects of the invention is shown in FIGS. 24-28. System 700 is the same as previously described system 600 except that the dividing wall is on a side of the cavity 702 to divide the cavity into two portions. The advantage of this design is that the heat from wall 703 helps to keep the molten metal on both sides of the dividing wall at the proper temperature.

In system 700, vessel 701 is essentially the same as vessel 501, and includes a cavity 702 that receives molten metal from a larger vessel which is defined in part by wall 703. The pump 710 is preferably the same as previously described pump 20, although any suitable pump may be used. Any suitable structure for securing the pump 710 into position as those described in this specification may be utilized for system 700, or any other suitable structure, and one specific structure is described below.

System 700 includes a dividing wall 750 that divides cavity 702 into a first portion 702A and a second portion 702B. Dividing wall 750 includes an opening 752 that is in fluid communication with the pump 710 outlet 717, so as the pump is operated it moves molten metal from portion 702A to portion 702B.

A launder outlet 780 has a portion 780A that is formed in the front wall of vessel 701 and a portion 780B that extends from the front wall of vessel 701, and that is preferably cemented to or cast as part of the front wall of vessel 701.

As motor 710 operates it moves molten metal through the opening 752 and raises the level of molten metal in portion 702B until it reaches launder outlet 780 and exits vessel 701. Wall 750 is high enough to prevent molten metal from spilling over the top and into portion 702A.

Figure 24:
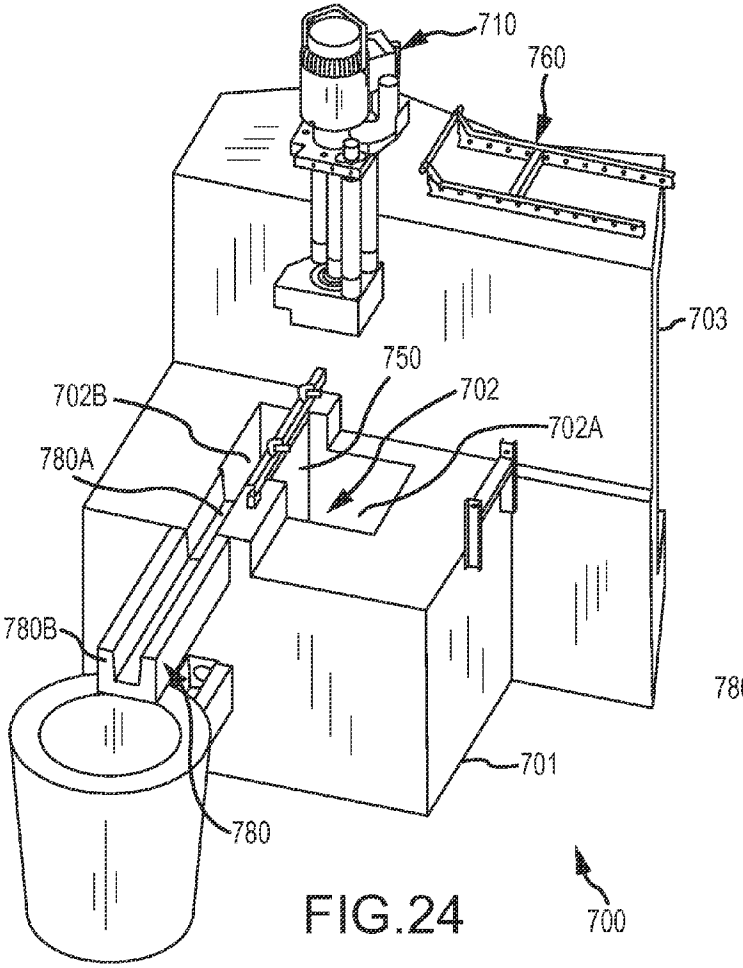
FIG. 24 shows an alternate embodiment of a system according to aspects of the present invention.
Figure 27:
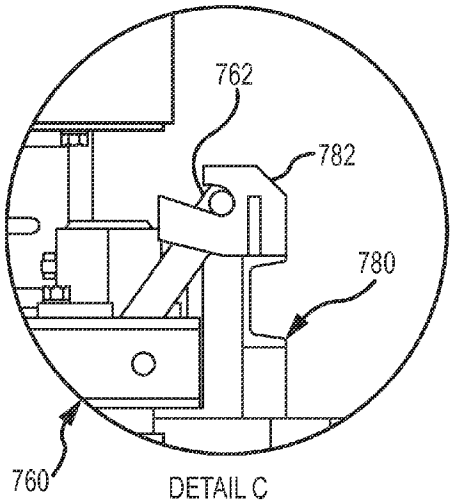
FIG. 27 shows the detail C of FIG. 26.

FIG. 27 shows a close up detail of a previously-described pin and slot connector that makes it relatively easy to properly position pump 710 with dividing wall 750. The slots 782 are on a bracket 780 that is mounted on the top surface of vessel 701, as best seen in FIG. 24. Then pins 762, which are part of brackets 760 that support pump 710, are placed into slots 782 to properly position the pump 710 relative dividing wall 750.

Figure 28:
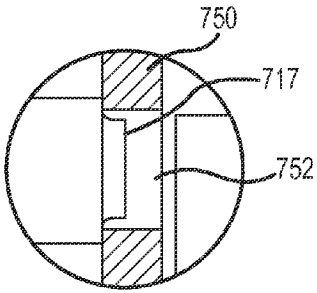
FIG. 28 shows the detail D of FIG. 26.
Figure 26:
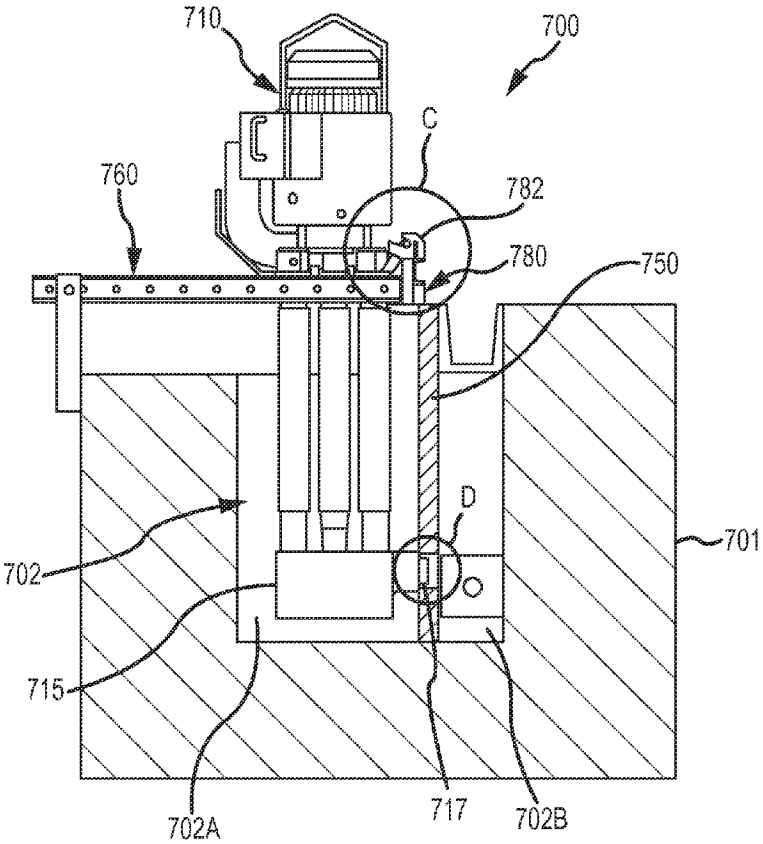
FIG. 26 is a side, partial cross-sectional view taken along lines AA of FIG. 23.

FIG. 28 shows an enlarged view of the portion of the pump chamber 715 of pump 710. Snout 717 of the pump base extends into opening 752 to help ensure a flow of molten metal through the dividing wall opening 752.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A pumping device for placement into a pumping well for pumping molten metal, the pumping device including (a) a pump having a motor, a rotor and a drive shaft connecting the motor to the rotor, and (b) a portable refractory housing in which the molten metal pump is positioned; the portable refractory housing including: (i) an inlet, (ii) an uptake tube having a first section with a first cross-sectional area and a cylindrical second section with a second cross-sectional area, wherein the cylindrical second section is above the first section and the cylindrical second cross-sectional area is larger than the first cross-sectional area, and (iii) an outlet in communication with the second section, (c) the rotor being positioned in the first section, and (d) the pump being removable from the portable refractory housing without removing the portable refractory housing from the pumping well, and the portable refractory housing being removable from the pumping well, and; wherein the pump includes a first side and a mounting flange on the first side, the mounting flange for connecting to the platform, wherein the platform is on a top surface of the portable refractory housing.

2. The pumping device of claim 1 that further includes a launder attached to the outlet.

3. The pumping device of claim 1 wherein the portable refractory housing has a rectangular outer surface.

4. The pumping device of claim 1 wherein the pump rests on a platform above the portable refractory housing so the rotor is positioned in the first section.

5. The pumping device of claim 1 wherein the pump includes a second side and a second mounting flange on the second side, the second mounting flange for connecting to the platform on the portable refractory housing.

6. The pumping device of claim 2 wherein the portable refractory housing includes a front side with one or more front flanges, and the launder has a first end proximal the pump and a second end distal the pump, the first end of the launder having one or more launder flanges wherein each of the one or more launder flanges aligns with one of the one or more front flanges for connecting the launder to the portable refractory housing.

7. The pumping device of claim 1 wherein the portable refractory housing includes a bottom surface and the pump is not in contract with the bottom surface.

8. The pumping device of claim 1 wherein the launder has a top to retain heat.

9. The pumping device of claim 2 that includes a pumping well having a top surface wherein the launder rests on the top surface of the pumping well.

10. The pumping device of claim 1 wherein the outlet is horizontal.

11. The pumping device of claim 2 wherein the launder is horizontal.

* * * * *